US010820761B2

(12) United States Patent
Lange et al.

(10) Patent No.: US 10,820,761 B2
(45) **Date of Patent: *Nov. 3, 2020**

(54) COMPACT AUTOMATED WINDOW WASHING APPARATUS

(71) Applicant: Pachanga Holdings, LLC, Little Canada, MN (US)

(72) Inventors: Michael R. Lange, Little Canada, MN (US); Jim Berres, St. Paul, MN (US); James G. Pritschet, Oakdale, MN (US)

(73) Assignee: Pachanga Holdings, LLC, Little Canada, MN (US)

( * ) Notice: Subject to any disclaimer, the term of this patent is extended or adjusted under 35 U.S.C. 154(b) by 508 days.

This patent is subject to a terminal disclaimer.

(21) Appl. No.: 15/625,516

(22) Filed: Jun. 16, 2017

(65) Prior Publication Data

US 2017/0347847 A1 Dec. 7, 2017

Related U.S. Application Data

(63) Continuation of application No. 14/062,836, filed on Oct. 24, 2013, now Pat. No. 9,681,784.

(60) Provisional application No. 61/717,730, filed on Oct. 24, 2012.

(51) Int. Cl.
*A47L 1/02* (2006.01)
*E04G 23/00* (2006.01)

(52) U.S. Cl.
CPC ..... *A47L 1/02* (2013.01); *E04G 23/002* (2013.01)

(58) Field of Classification Search
CPC ..... A47L 1/02; E04G 23/002
USPC ..... 15/103, 103.5, 50.3, 52.1, 98, 52
See application file for complete search history.

(56) References Cited

U.S. PATENT DOCUMENTS

| | | | | |
|---|---|---|---|---|
| 3,298,052 | A * | 1/1967 | Wolfe | A47L 1/02 15/302 |
| 5,465,446 | A * | 11/1995 | Chang | A47L 1/02 15/103 |
| RE36,649 | E * | 4/2000 | Jefferies | A47L 1/02 15/103 |
| 6,493,902 | B2 * | 12/2002 | Lin | E04G 3/34 15/302 |
| 9,681,784 | B2 * | 6/2017 | Lange | A47L 1/02 |
| 2009/0044833 | A1 * | 2/2009 | Simonette | A47L 1/02 134/18 |
| 2009/0100618 | A1 * | 4/2009 | Chen | E04G 23/002 15/103.5 |

FOREIGN PATENT DOCUMENTS

| | | | | |
|---|---|---|---|---|
| FR | 2654652 | A1 * | 5/1991 | A47L 1/02 |

OTHER PUBLICATIONS

Computer generated English Translation of FR 2654652 A1, Nicolaieff, May 1991. (Year: 1991).*

* cited by examiner

*Primary Examiner* — Laura C Giudotti
(74) *Attorney, Agent, or Firm* — Skaar Ulbrich Macari, P.A.

(57) ABSTRACT

An automated washing system for vertical surfaces of buildings can include a frame, a main brush rotatably disposed in the frame, at least two bumper wheels provided to opposing ends of the frame where the at least two bumper wheels can contact the vertical surfaces of building during a cleaning operation; and an electric drive motor disposed adjacent one of the opposing circular ends of the main brush.

18 Claims, 21 Drawing Sheets

COMPACT AUTOMATED WINDOW WASHING APPARATUS

PRIORITY

This application is a continuation of U.S. patent application Ser. No. 14/062,836, filed Oct. 24, 2013, which claims the benefit of U.S. Provisional Application Ser. No. 61/717,730, filed on Oct. 24, 2012, and each of the foregoing applications is hereby incorporated herein by reference in its entirety.

FIELD

The present invention relates generally to window washing devices and, more particularly, to compact and easily portable automated window washing devices for buildings.

BACKGROUND

Building structures, particularly tall urban buildings, were typically washed manually. In manual washing, a scaffolding structure would be suspended from the top of the building to be washed. The scaffolding can be raised or lowered so that a person standing on the scaffolding can wash the windows and exterior surfaces of the building by hand. After a vertical section of the building is washed, the scaffolding is repositioned laterally so that the next adjacent vertical section of the building may be cleaned. This procedure was repeated until the entire building was washed. This and other methods of manually cleaning windows of a building have proven to be extremely time consuming and labor intensive.

Manual washing of buildings is also unacceptably dangerous. Equipment can fail and fall. Operators can misuse the equipment and fall. And environmental conditions, such as wind and precipitation can make the cleaning operations more dangerous or even impossible. Thus, insurance rates for manual cleaning operations can comprise a significant portion (e.g. 40%) of labor costs.

To address the aforementioned problems, various types of automated window washing devices have been developed. For example, U.S. Pat. No. 7,665,173 discloses one such automated window washing device. The entirety of U.S. Pat. No. 7,665,173 is hereby incorporated herein by reference. However, the device shown in this patent is relatively large and heavy. This means that the apparatus must be transported in a large commercial size vehicle and there must be a team of operators to operate the device. It also requires rigging capable of lifting at least 2000 pounds. Thus it is best suited only for use on very large buildings such as skyscrapers. The power requirements of such large devices are also significant, which requires a dedicated power cable (typically 220V) to be connected the device. Additionally, this large and complex device is very expensive.

Other issues and disadvantages of conventional automated window washing devices such as that in U.S. Pat. No. 7,665,173 include: heavy weight (e.g. 600 lbs.); too large to fit into a pickup truck; must use uses fans and weights to hold against building; takes 2 people all day to setup—heavy and hard to move; travels approximately 35 feet per minute; high cost for the large and complex machine; suited only for taller buildings so limited market opportunity; high volume cleaning solution use (e.g. 4 gallons per minute); complex and expensive rigging; typically uses 5/16" wire rope (heavy); heavy winch—120 lbs.; have on-board deionizing filter with 220 volt motor, which adds weight and complexity; heavy and welded frame contributes to high device cost and weight; requires ¾" water line; and uses noisy stabilizer fans.

Therefore, there is an ongoing need to provide a compact and easily portable automated window washing device, system, and method for the same that addresses, at least in part, the above-mentioned drawbacks of the conventional devices.

SUMMARY

The present invention addresses various of the above-noted issues with conventional window washing methods and automated machinery for the same. In one example embodiment, an automated washing system for vertical surfaces of buildings comprises a frame assembly including a substantially planar base portion and a mast portion extending upwardly from the base portion. A pair of rolling wheels are disposed on the opposing sides of the base portion and located adjacent the rear end thereof. A main brush is rotatably disposed between the opposing sides of the base portion and adjacent the rear end thereof. A shroud extends the length of the main brush and encloses a portion of the of the circumferential surface of the main brush opposite the vertical surface of the building. An electric drive motor drives the main brush and is powered by an onboard battery. Bumper wheels disposed on the shroud extend laterally outwardly beyond from the opposing circular ends of the main brush. The angle between the mast and the base is configured to hold the main brush against the vertical surface of the building when the mast is lifted vertically by a cable attached to the mast.

The system and device are compact and lightweight. The size and weight make for quick and easy setup, use and transport by a two persons using a standard vehicle or small trailer. Additional aspects, features and advantages are described herein below and are shown in the appended drawings.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
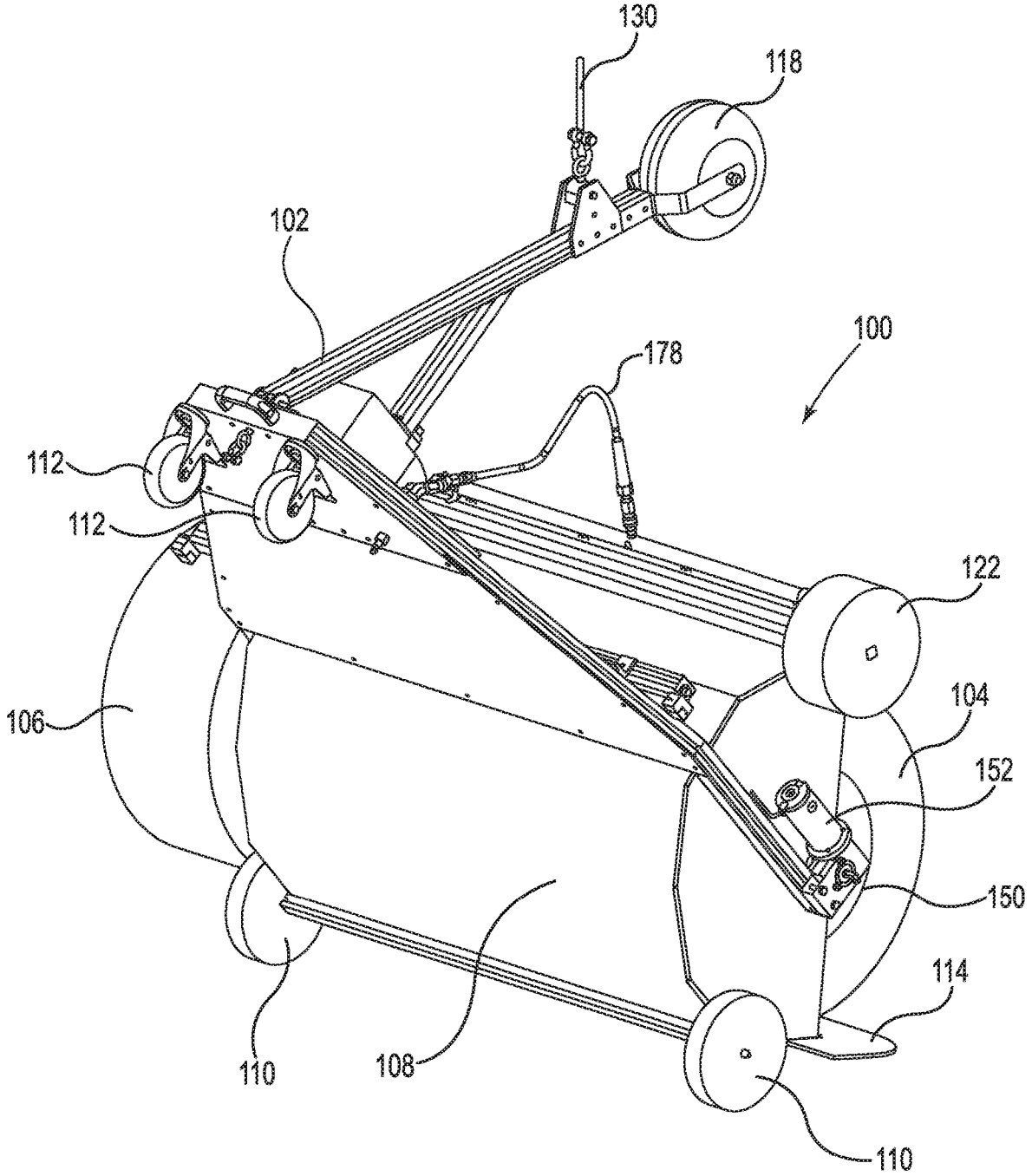
FIG. 1 is a perspective view of an automated washing apparatus according to certain embodiments of the invention.
Figure 2:
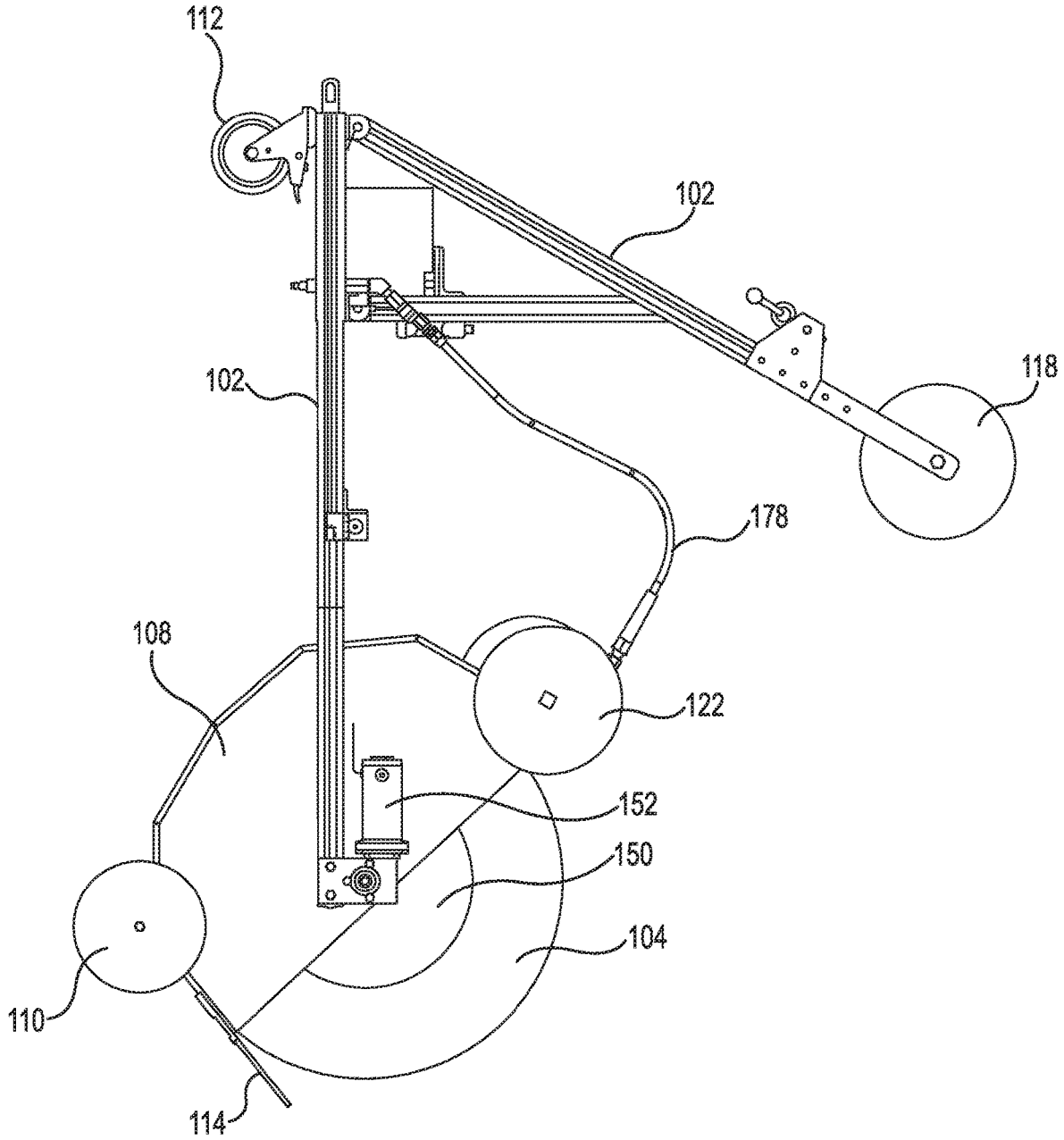
FIG. 2 is a side view of an automated washing apparatus according to certain embodiments of the invention.
Figure 3:
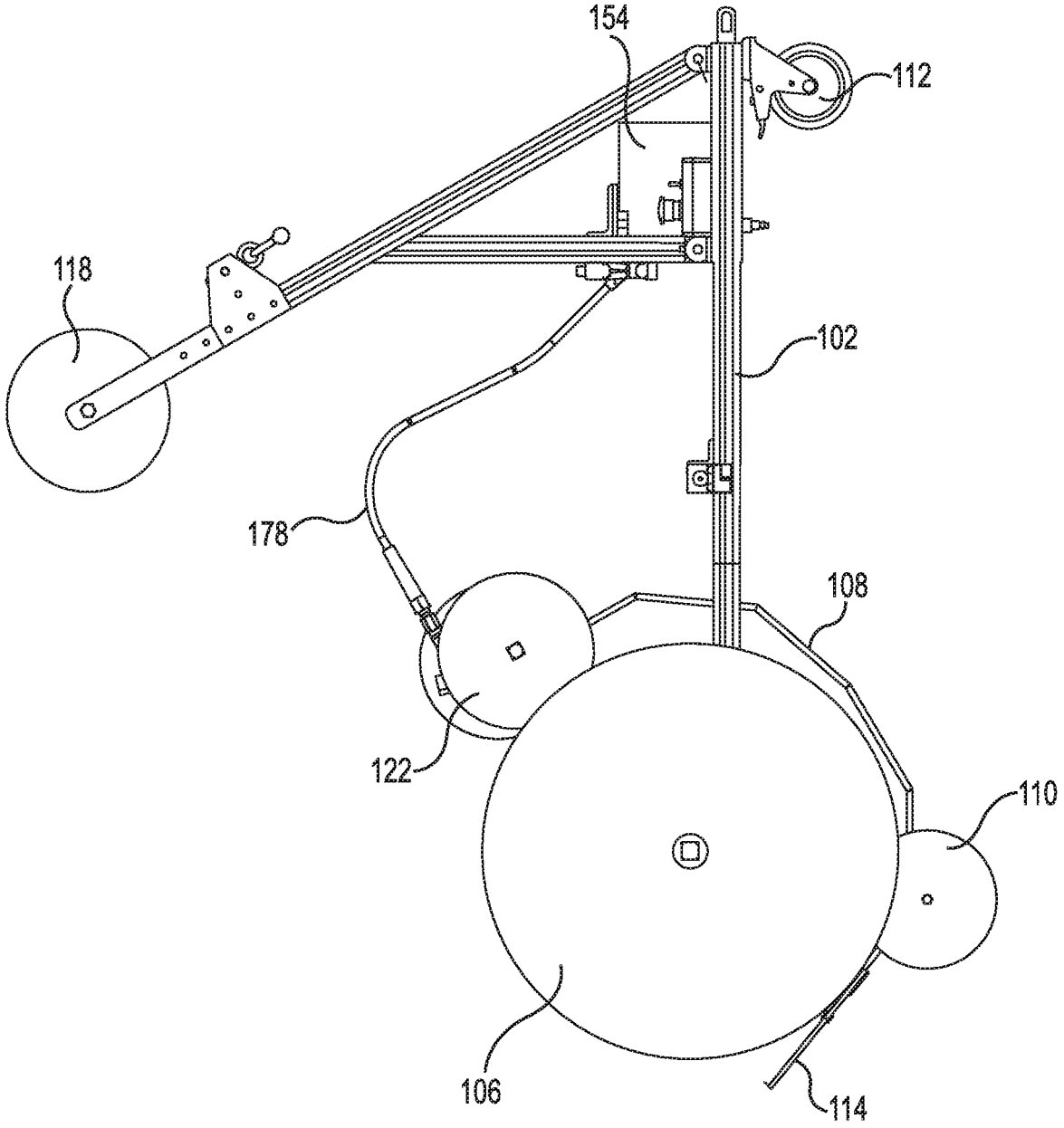
FIG. 3 is a side view of an automated washing apparatus according to certain embodiments of the invention.
Figure 4:
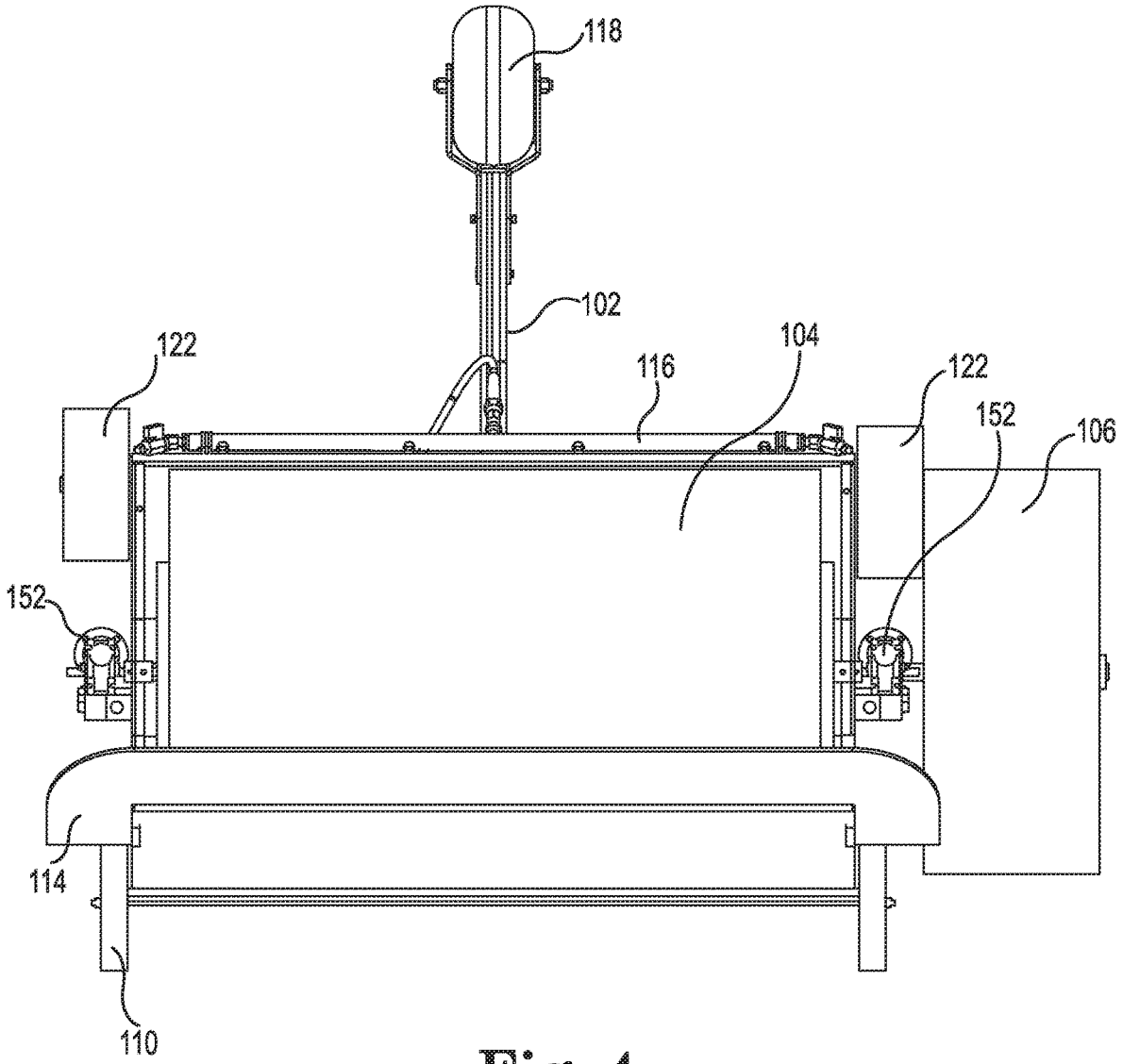
FIG. 4 is a front view of an automated washing apparatus according to certain embodiments of the invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention.

Referring to the FIGS. generally, various views of an automated window washing device 100, and components thereof, are shown. The device 100 generally comprises a metal, plastic, polymer or composite frame and a rotating brush. In one example, the frame is formed of an aluminum alloy. The metal frame comprises a plurality of tubular sections that are bolted, welded or fastened together via typical means to form the shape as shown.

Referring now more specifically to FIGS. 1-8, the automated window washing apparatus 100 generally comprises a frame assembly 102, a main brush 104, a side brush 1-6 and a shroud 108 enclosing approximately half of the diameter of main brush 104 from end-to-end.

A plurality of rolling wheels 110 are provided to the underside of the shroud or to rear (brush end) of the frame. One or more caster wheels 112 are provided to the underside of the frame adjacent the front end thereof. These wheels 110 and 112 allow the washing apparatus 100 to be easily rolled along the ground by a user, for example, from the transport vehicle to the building to be washed, and back. The wheels allow the person to pull or push the device 100 from the truck or trailer to the building to be cleaned, and reposition the device on the ground, if necessary. The wheels can remain attached during the cleaning operation, or they can be releasable with a quick pin if removability is desired. The wheels also act as landing gear for when the machine drops from the side of the building to the ground.

A splash guard 114 is disposed on lower end of the shroud 108 and extends at least the width of the shroud and outward from the shroud towards the surface to be cleaned (when oriented in the cleaning position. The splash guard reduces the likelihood that water droplets fall downward away from the building. In one embodiment, the splash guard is a brush mounted on a rigid base member. In another embodiment, the guard is a flexible rubber baffle.

A spray bar 116 is disposed along an upper edge of the shroud and configured to supply cleaning solution to the main brush. The spray bar also includes an adjustable side nozzle (discussed later herein) for supplying cleaning solution to the side brush(es).

A top bumper wheel 118 is disposed in an upper mount 120 of the frame 102. The top bumper wheel protects the frame and the building in the event that the top of the mast 128 would come into contact with the building's surface/windows, such as might happen in high/gusty winds.

A pair of bumper wheels 122 are disposed one each adjacent each longitudinal end of the shroud 108 where they can contact the building surface during cleaning. Each bumper 122 is longitudinally extendable away from the shroud to create a widened track so that twisting of the apparatus 100 about a vertical axis is resisted. The longitudinal extension capability is provided by the bumper wheels 122 being mounted to telescoping members 124. The bumper wheels 122 can be formed of a foam material. The wheels 122 can also be configured as foam balls to provide a soft contact surface so the building surface is not damaged or scratched. The telescoping bumper wheels/balls 122 can be extended by the operator as needed in windy conditions. The wheels/balls 122 can be maintained in the retracted position when it is not windy or during storage and transport.

Referring generally to FIGS. 1-8 and particularly to FIGS. 9-12, the frame assembly 102 can be seen. The frame assembly generally comprises a substantially planar base portion 126 and a mast portion 128 extending upwardly from the plane of the base. The angle $\alpha$ formed between the mast and the plane of the base is approximately sixty degrees in a preferred embodiment. Thus in side view, the base and mast generally resemble the number seven that has been tilted slightly clockwise. In a majority of configurations, this angle results in the brush being held against the vertical building surface with a counterforce generated by the weight of the batter being laterally offset from the point where the mast is connected to a cable 130. However, other angles (e.g. 20 degrees to 80 degrees) can be provided without departing from the scope of the invention. A vertical hinged support strut 132 extends upward from the frame to reduce flexure in the mast member 128 and to further secure the mast 128 to the frame base 126.

The mast 128 can be mounted to the frame via a hinge. The strut 132 can be fastened with a quick release fastener. This arrangement allows the mast to be folded down for transport by pulling the release pin of the strut. A handle can be provided to the top of the mast to aide in pulling or pushing the machine from the truck/trailer to the building or from the building to the truck/trailer.

Figure 11:
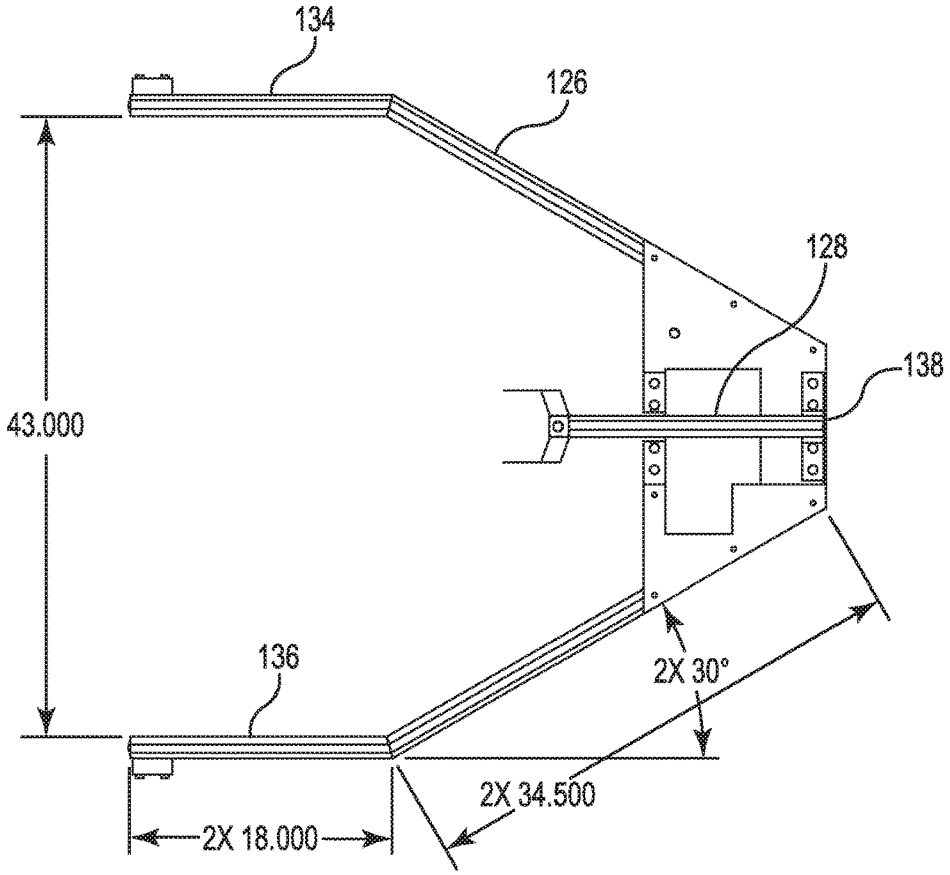
FIG. 11 is a top view of a frame assembly for an automated washing apparatus according to certain embodiments of the invention.
Figure 12:
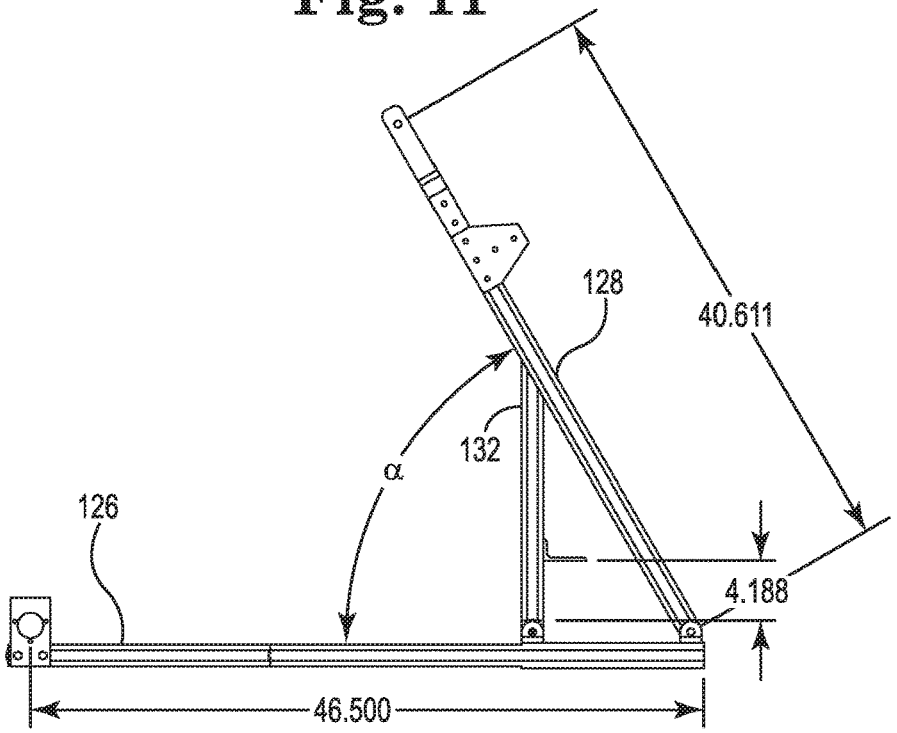
FIG. 12 is a side view of a frame assembly for an automated washing apparatus according to certain embodiments of the invention.

The dimensions indicated in FIGS. 11-12 are in inches. These dimensions are for one example embodiment. The dimensions can, of course, be altered without departing from the scope of the invention. The dimensions are not intended to be limiting of the scope of the invention unless a particular dimension is explicitly recited in a given claim, and then only the recited dimension is so limited and for only the claim in which it appears.

The base 126 in a top view generally resembles the letter A. Opposing leg members 134 and 136 generally converge as they approach the front end defined by the nose bar 138. The ends of legs opposite the nose include brackets 140 for mounting the brushes and drive motors.

A partial top trim plate 142 and bottom trim plate 144 can be provided to a respective top and bottom side of a portion of the base 126. The top plate can support the battery or other components. The bottom plate adds stiffness to the frame. A cross member 146 further supports the respective plates and adds stiffness to the frame assembly.

Figure 5:
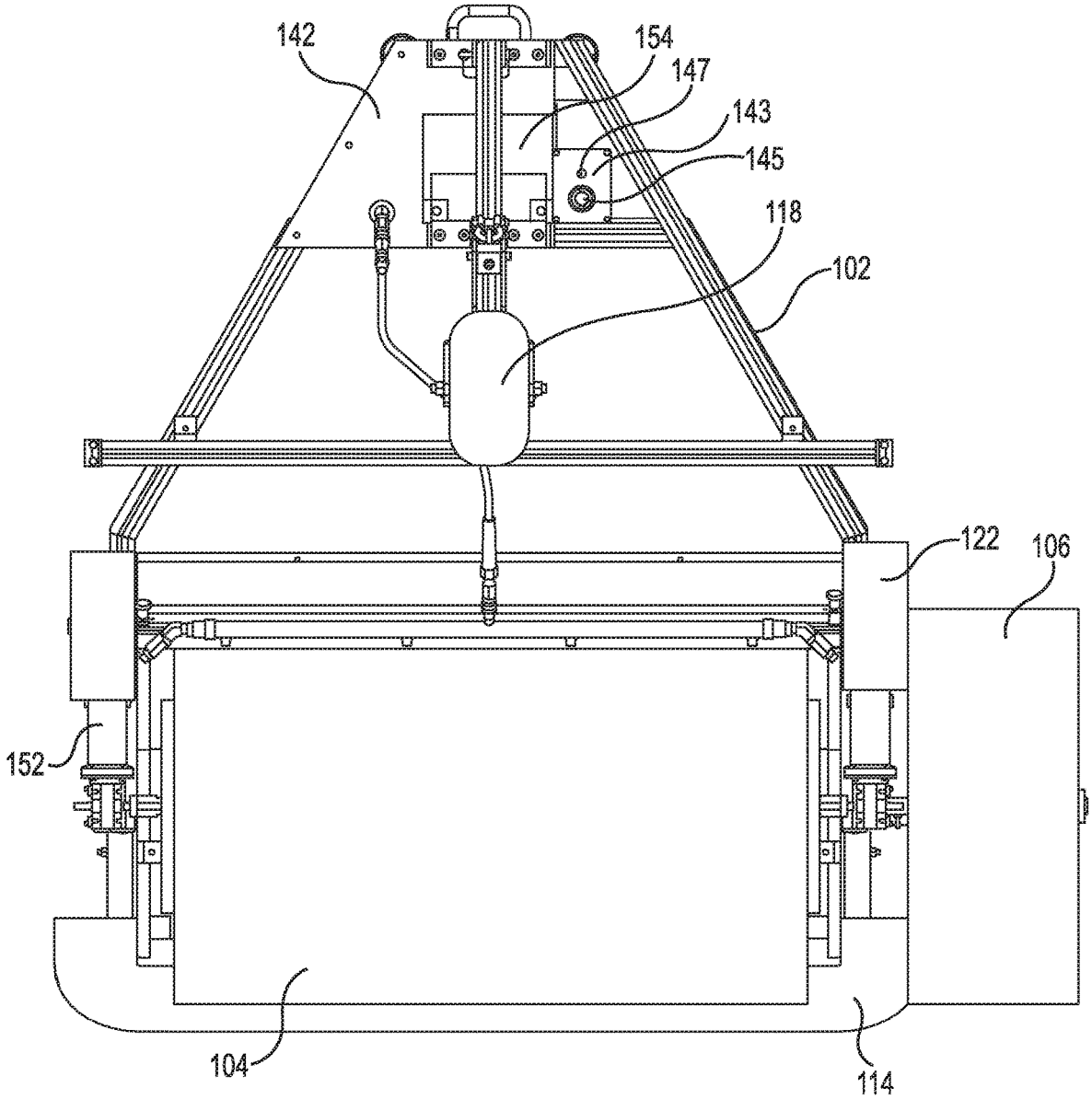
FIG. 5 is a top view of an automated washing apparatus according to certain embodiments of the invention.
Figure 6:
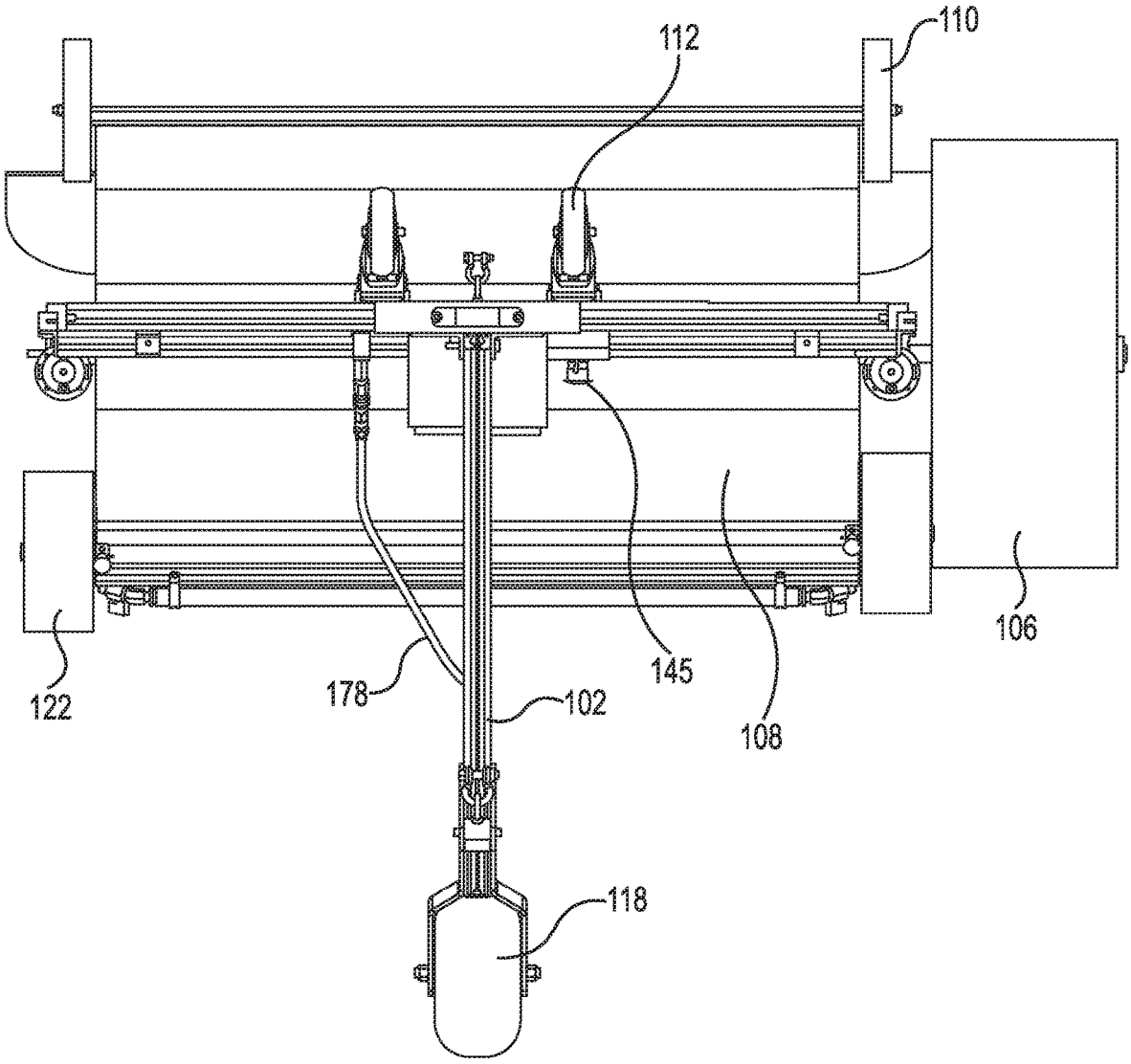
FIG. 6 is a rear view of an automated washing apparatus according to certain embodiments of the invention.
Figure 7:
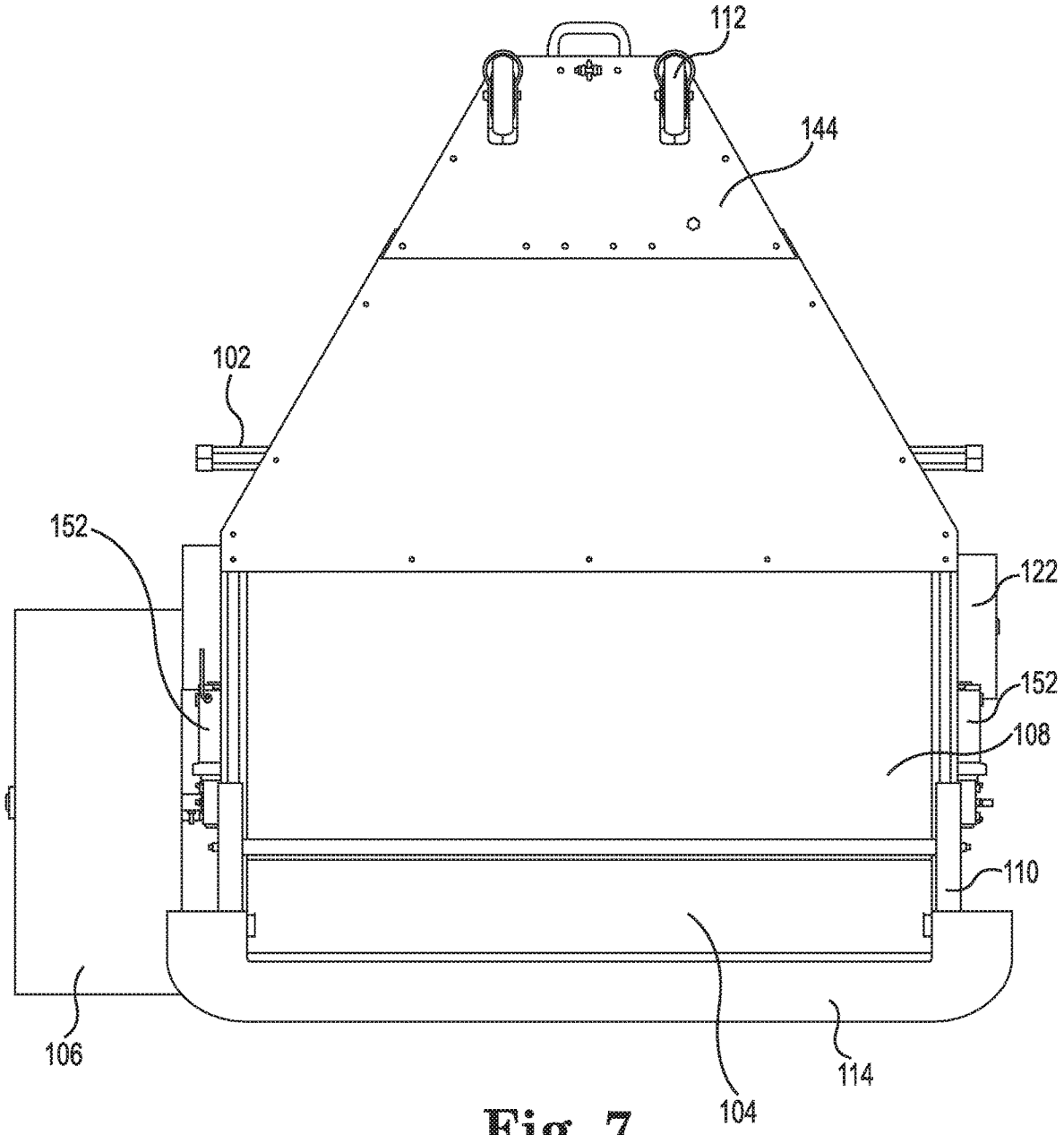
FIG. 7 is a bottom view of an automated washing apparatus according to certain embodiments of the invention.

A control box 143, as shown in FIG. 5, can be mounted on top of the top plate 142. The control box contains the control electronics for the device, such as a processor and/or a circuit board. An emergency stop button 145 can be disposed on the control box, or on another portion of the device that is conveniently accessible by the operator. Indicator lights, such as light emitting diodes, can be provided to the control box 143 to provide the operator with a visual indication of the operating status of the apparatus, for example, powered on and/or in motion. One or more toggle switches 147 can also be provided to the control box's housing to control functions such as On/Off, forward/reverse brush direction, and to manually spin the brush(es). A user can be provided with a hand-held wireless remote control in order to remotely control all of the above-noted functionality. In such embodiment, the control box includes an antenna receiver to communicate with the hand-held wireless remote. The remote could also be hard-wired to the control box in an alternative embodiment.

Figure 13:
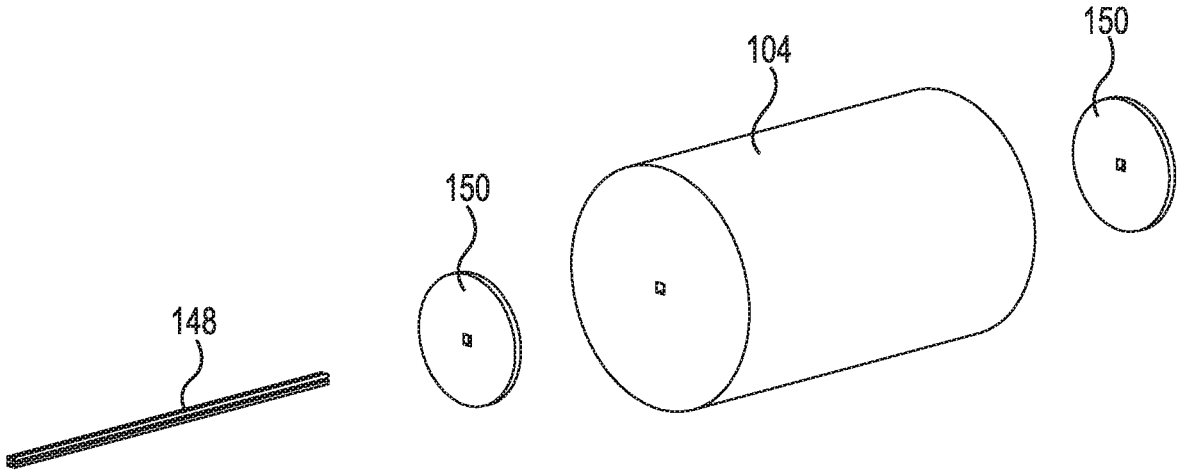
FIG. 13 is a perspective exploded view of certain components of a main brush assembly for an automated washing apparatus according to certain embodiments of the invention.

Referring generally to FIGS. 1-8 and particularly to FIG. 13, the main brush 104 assembly can be seen. The brush 104 is rotationally mounted about an axle 148. The end portions of axle 148 are supported by the brackets 140 disposed on the ends of the opposing legs 134 and 136.

A spacer disk 150 is disposed adjacent each end of the main brush body. The spacer disks comprise a material with minimal radial compressibility so that a minimum compressible brush diameter is defined between the brush and the vertical surface of the building. The spacer disks 150 ensure that the frame 102, shroud 108 or other part of the machine 100, other than the brushes, does not contact the building. Also, the spacer disks provide a generally non-flexible spacing on either side of the brush to add stability to the machine during operations such as resisting twisting about a vertical axis. These spacer wheels have a diameter approximately three inches less than the cleaning brush diameter in one example embodiment. Thus in this example, the spacers 150 maintain three inches of brush depth to contact the surface to be cleaned at all times. Spacer disk diameter can thus be adjusted to easily adjust the brush cleaning depth for different size window frames.

The main brush 104 is driven rotationally about its axle via an electric motor 152 disposed on either side of the axle. One suitable type of motor is a Groschopp, 12 v, DC right-angle, geared motor, although other suitable motors may be used without departing from the scope of the invention. In another alternative, two motors can be used, one mounted to each end of the axle. In a further alternative, the drive motor(s) can be mounted away from the axle and connected to a drive chain/belt/cable or a gearbox that is operatively coupled to the main brush. The motor(s) preferably spin the main brush at a speed of between 40 and 60 rotations per minute. The direction of rotation can also be reversed and the RPM'S can be changed as desired by the operator.

In one example embodiment, the main brush 104 is 40 inches long, with a 24 inch nominal outside diameter. However other lengths and diameters can be used to accommodate building sizes and window sizes. The brush preferably comprises a plurality of flexible individual finger elements secured at their base to a rotating brush base. One preferred material is Neoglide foam, which will not scratch the glass, but is nonetheless a durable and flexible material. Such brush can be obtained from suppliers such as Kirikian Industries. However those of skill in the art will recognize that other suitable brushes can be used without departing from the scope of the invention. The main brush can also comprise microfiber filaments, which are adapted to dust the building without the need for cleaning solution or water.

Figure 14:
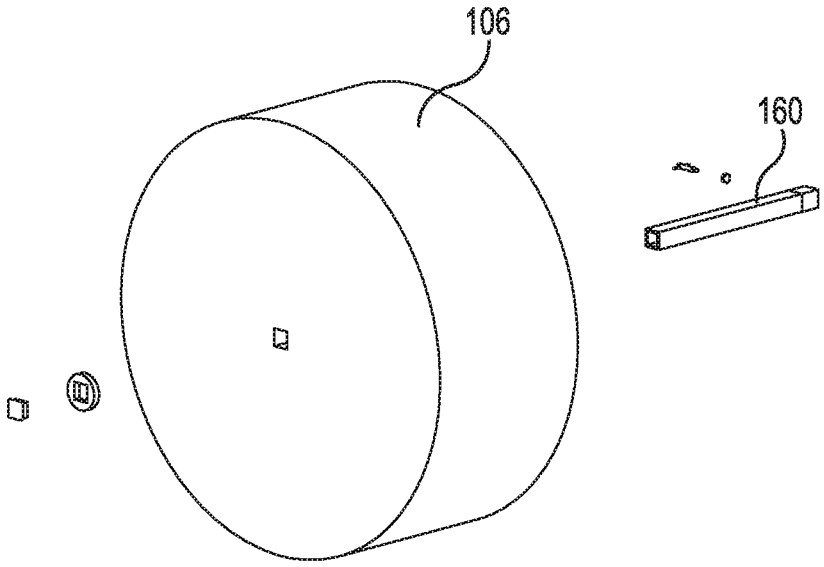
FIG. 14 is a perspective exploded view of certain components of a side brush assembly for an automated washing apparatus according to certain embodiments of the invention.

Referring generally to FIGS. 1-8 and particularly to FIG. 14, a side brush 108 assembly can be seen. The side brush 106 is rotationally mounted about an axle 160. One end of axle 160 is removably fastened to one of the mounting brackets 140 disposed on the ends of the opposing legs 134 and 136. The optional side brush is used to clean inside and outside corners where the building surface turns inwards to another building surface. The side brush material and construction is the same as for the main brush, except that the outer end surface is provided with a plurality of cleaning filaments as well. The side brush 106 can be easily attached with quick pins to either side of the device and will rotate as the main cleaning brush rotates. The brush assembly can thus clean both parts of the building at the same time as shown in the images. The side brush can be mounted to either side of the frame to adapt to a variety of building configurations.

A small counterweight can be added to the opposite side of the frame (by quick pinning, etc.) so that the frame remains balanced. The side brush can also be used to clean outer corners where sometimes the top rigging cannot go all the way to the corner. The side brush can be extended a few feet to reach the outside corner. Two side brushes can also be mounted and used at the same time to clean the building faster.

The drive motor(s) 152 can be electrically powered by an electrical cord connected to a power source, or by an onboard battery. Referring to FIGS. 1-8, the device 100 is shown as being powered by an onboard battery 154. The battery 154 is secured to an outward portion of the frame 102 (i.e. opposite the brush side) adjacent the mast member 128 via a battery hold down bracket 155. Such positioning of the battery (and additional weights if necessary) causes a moment or rotational force to be generated through the cable attachment point, thereby counterbalancing any force pushing the device away from the building. In other words, the lever force exerted by the battery 154 being outside of a vertical line extending downward from the point of attachment to the cable 130 causes the main brush 104 to be pushed against the glass or other surface to be cleaned. Thus, the machine 100 is held relatively close to the building while putting constant pressure on the brush 104 to the surface to be cleaned. Even in high wind speeds, the machine stays secure against the surface being cleaned.

The preferred battery is generally the size of a typical automotive battery, but is a Lithium-ion type battery (12 v/40H). Such batteries have sufficient energy density to provide many hours of operation without need of recharge. These batteries also recharge quickly and have a long life span. They are also relatively lightweight (approx. 14 pounds). When the battery runs low, the operator can quickly disconnect the cable, pull out the battery from its mounting hardware and replace it with a charged battery. Use of two batteries for a given machine allows the operator to charge one (approximate charge time is 1-2 hours) while the other is being used to power the washing device 100.

In an alternative embodiment, two or more batteries can be utilized with the present device. In one aspect, two or more batteries can be quickly swappable so that a charged battery can replace a discharged battery. Or the second battery can be onboard already and can be easily switched. Or multiple batteries can be wired in parallel. The result is that the potential machine usage time is lengthened. In a second aspect, a first battery can be used to provide power to the brushes while a second on-board battery can be used to power other aspects such as a remote control receiver and/or a winch.

Figure 15:
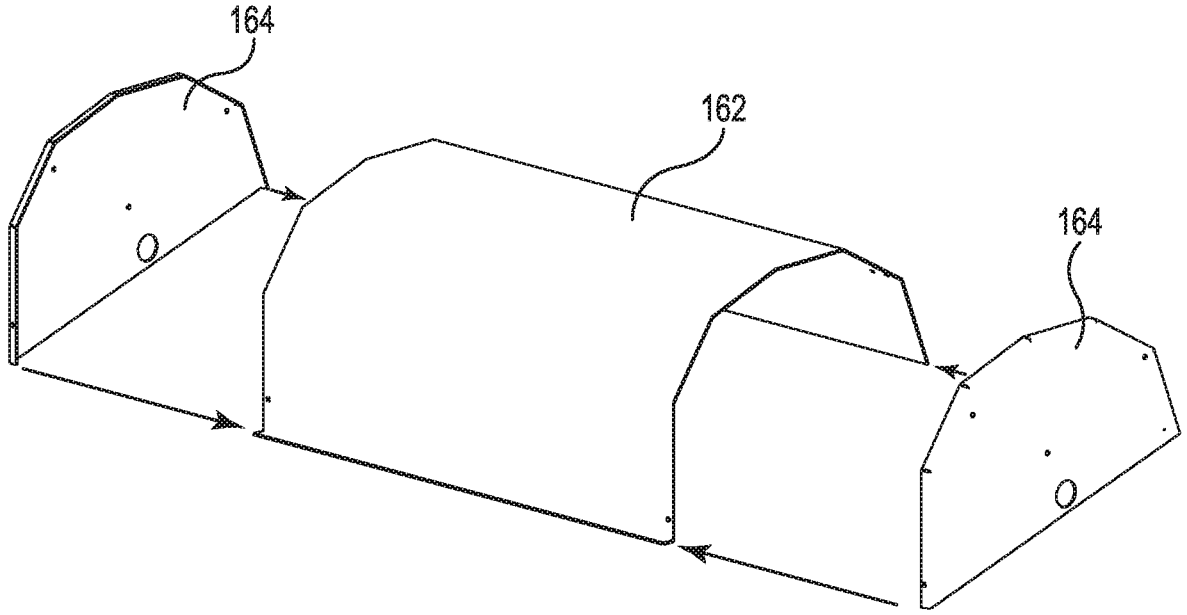
FIG. 15 is a perspective exploded view of a shroud assembly for an automated washing apparatus according to certain embodiments of the invention.
Figure 16:
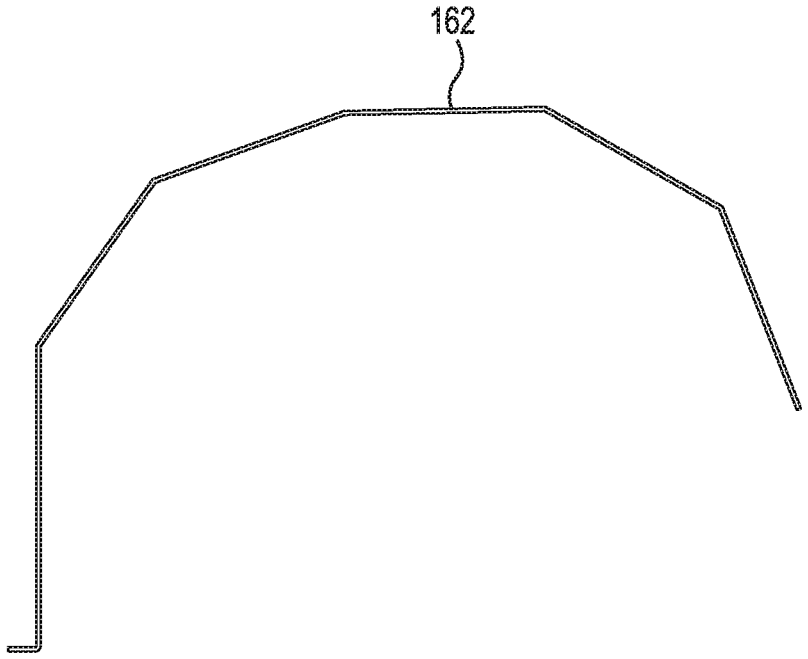
FIG. 16 is a side view of a shroud for an automated washing apparatus according to certain embodiments of the invention.

Referring generally to FIGS. 1-8 and particularly to FIGS. 15-16, the shroud 108 can be seen. The shroud 108 is disposed behind the main brush 104 opposite of the surface to be cleaned. The shroud encloses approximately half of the longitudinal surface (180 degree surround). The shroud functions to contain splashing and keeps any water running towards the building. The shroud is preferably made of lightweight material such as aluminum or plastic. But it could be out of other materials such as fiberglass, carbon fiber composite, or other suitable material. The shroud 108 comprises a domed body 162 with open ends. An end plate 164 encloses each end. In side view, the domed body 162 can be multifaceted as shown in FIG. 16, or it can be a smooth arc. The shroud can also be V shaped with a connector in the middle.

A gutter or trough can be provided across the bottom of the shroud to collect the water or cleaning solution that falls down from the shroud. This water can be transmitted via a drain hose to a suitable drain, or alternatively, be recycled by re-introducing it back into the cleaning fluid supply loop.

At the bottom end of the shroud 108 there is a static splash guard 114 as can be seen in FIGS. 1-8. The splash guard can be configured as a Sealeze brush with inner membrane in the middle of the brush filaments. The guard is attached to the shroud 108 and extending towards the building in order to keep the water from falling straight down the building. The water thus runs down the building instead of falling like rain. The static brush can also be made of a composite material. The guard also acts as a stabilizer to keep the brush pressure uniform.

Figure 8:
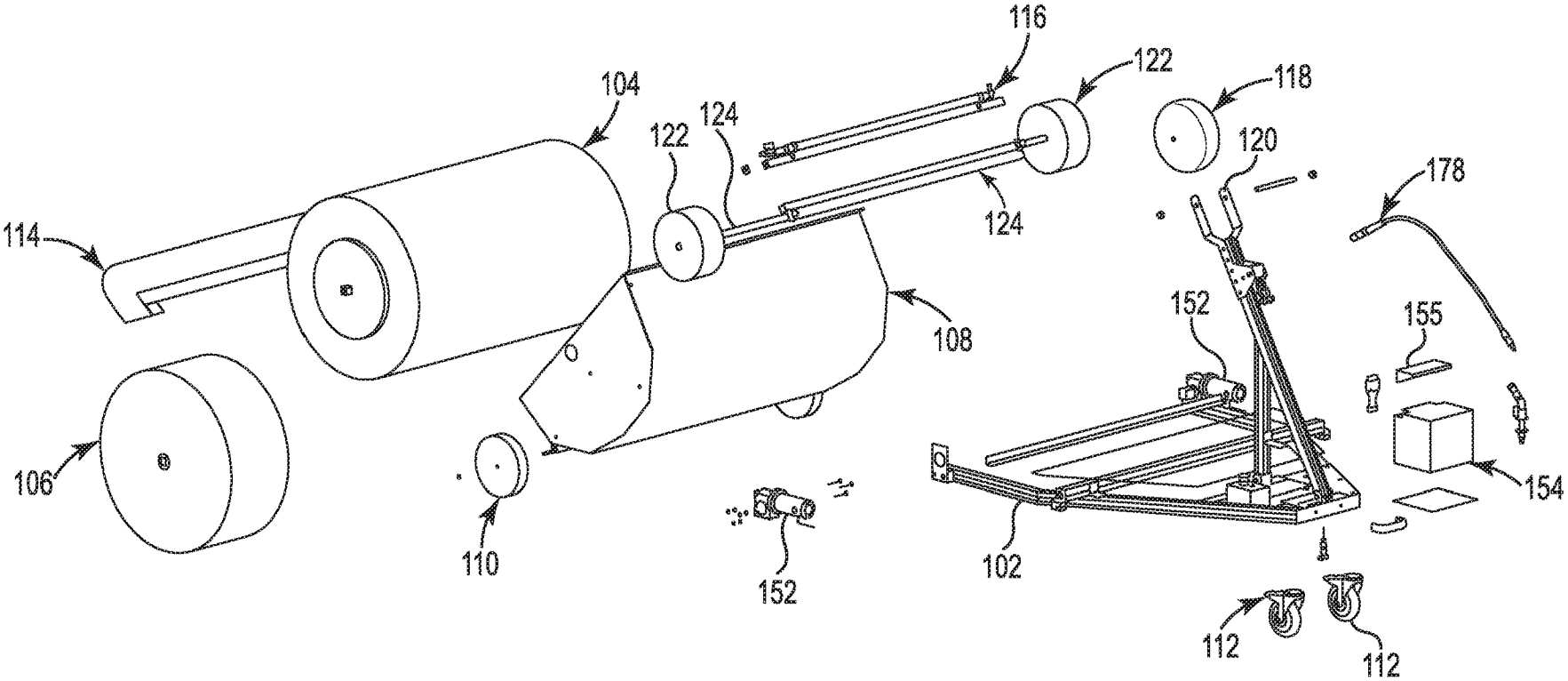
FIG. 8 is a perspective exploded view of certain components of an automated washing apparatus according to certain embodiments of the invention.
Figure 9:
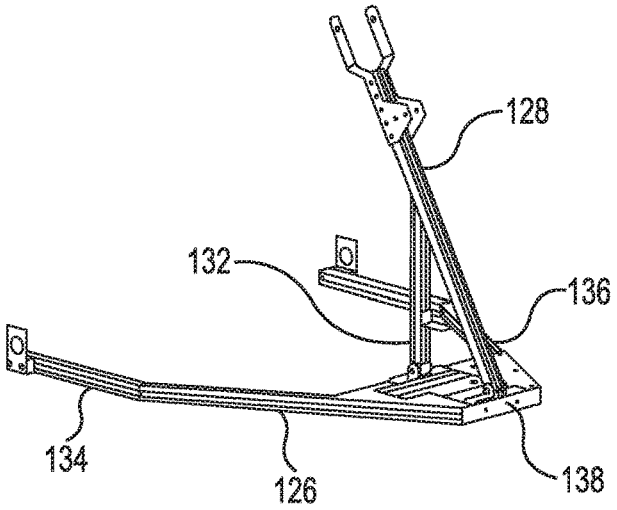
FIG. 9 is a perspective view of a frame assembly for an automated washing apparatus according to certain embodiments of the invention.
Figure 10:
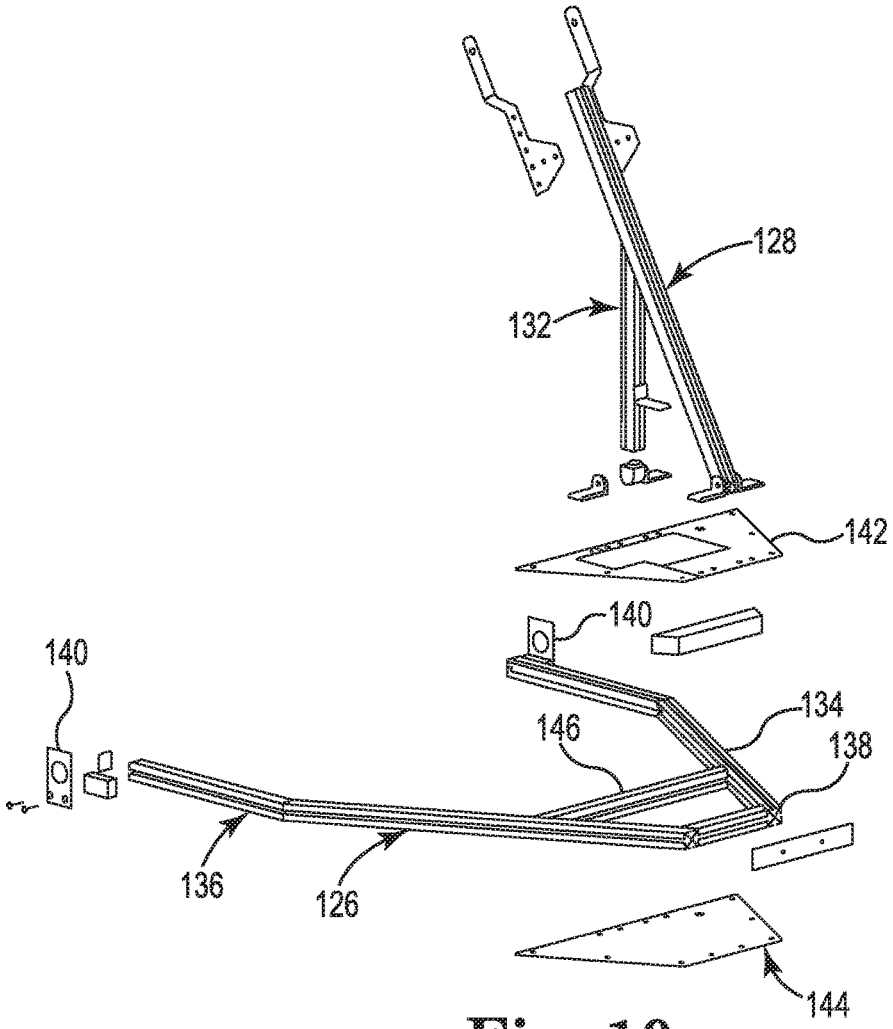
FIG. 10 is a perspective exploded view of certain components of a frame assembly for an automated washing apparatus according to certain embodiments of the invention.
Figure 17:
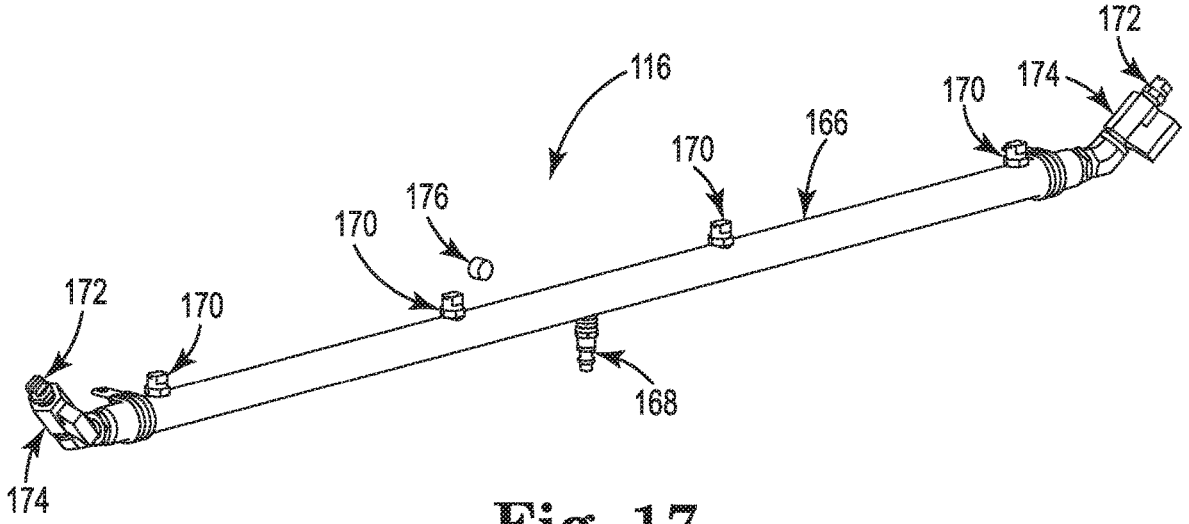
FIG. 17 is a perspective view of a spray bar assembly for an automated washing apparatus according to certain embodiments of the invention.

Referring to FIGS. 8 and 17, the cleaning apparatus includes a spray bar assembly 116 to spray clearing fluid, or water, on the brushes. The spray bar assembly is disposed horizontally along the top edge of the shroud 108. The spray bar assembly generally comprises a tubular body 166, a quick connector 168, and a plurality of spray nozzles 170. Additionally, side brush spray nozzles 172 extend from each end of the tubular body so that water/cleaning solution is sprayed towards the side brush(es). A valve 174 is disposed between the side brush spray nozzles 172 and the tubular body 166 so that the side nozzles can be selectably be turned on/off by the operator depending on the presence of a side brush. Moreover, each nozzle 170 can be capped with a cap 176, if desired. The spray bar assembly 116 is connected to the fluid supply by a supply conduit 178.

Figure 18:
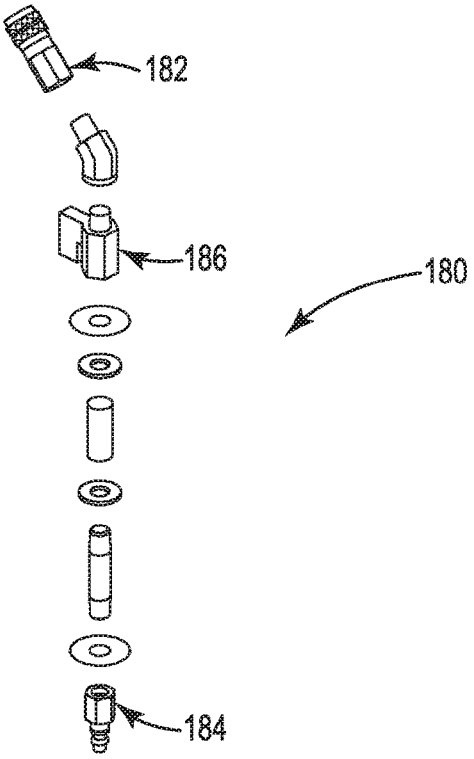
FIG. 18 is a perspective exploded view of a hose connection assembly for an automated washing apparatus according to certain embodiments of the invention.

Referring to FIGS. 8 and 18, the supply conduit connection subassembly 180 is shown. This subassembly is disposed on a forward portion of the frame base, such as on plates 142 and 144. The subassembly comprises an upper female quick connect coupling 182 for connecting to the supply conduit 178. The opposite end of the sub-assembly includes a male quick connect coupling 184 for connecting to a water/cleaning fluid supply hose. A valve 186 is disposes between the ends 182 and 184 to permit the supply of water/cleaning fluid to be turned on/off to the washing apparatus 100. The male connector 184 can extend below the bottom plate 144 so that the supply hose spanning to the ground can be easily maintained during cleaning without kinking. Additional washers, tubing portions and intermediate plumbing elements such as those shown in FIG. 18 can also be disposed between the ends 182 and 184 without departing from the scope of the invention.

The cleaning fluid can be supplied by a variety of sources. For example, a tank of solution and pump can be provided at ground or rooftop levels and connected to the apparatus 100 by a hose on a reel. The tank can be filled either on-site or brought to the site. In a preferred alternative, the cleaning fluid is deionized water. The water supply from the building, such as an outside water tap or spigot, is run through a deionizing and reverse osmosis (DI/RO) water filter which takes most minerals out of the water. Then a small supply hose is connected to the male connector 184 of the cleaning apparatus 100. Water flow rates of less than ¾ gallon per minute (e.g., ½ gal. per min.) are sufficient for the brush size and device operating speeds described herein. The main supply hose dangles downward off the outward end of the frame and down to the ground, thereby further acting as a counter weight for the device.

Preferred DI/RO filter units filter and ionize the water before it travels through the cleaning supply hose to the cleaning device. These DI/RO devices do not need separate power supplies as they operate based upon the water pressure provided by the available on-site water supply. However, a water pump and/or a powered DI/RO device are within the scope of the invention. Other suitable DI/RO devices can also be used within the scope of the invention unless specified in the claims.

Small weights can be added every few yards to the waterline to keep more weight on the back end of the machine and push the machine more forward to the building.

The DI water is sufficient to adequately clean the building and windows. Thus the cleaning process described herein is very environmentally friendly. Chemicals or environmentally safe chemicals can be injected into the machine, if desired.

The main supply hose reel preferably holds enough length of hose to reach the top of the building when connected to the machine. One suitable hose type is a small-diameter flexible non-kinking hose that can be wound up or unwound quickly from a reel or spool when starting or ending a cleaning job.

The modular construction of the present device and system makes it easily repairable if any portion is damaged. Various components can also be colored or painted, anodized, powder coated as desired. The space between frame portions can be provided with a screen to receive branding or advertising graphics as well.

Figure 19:
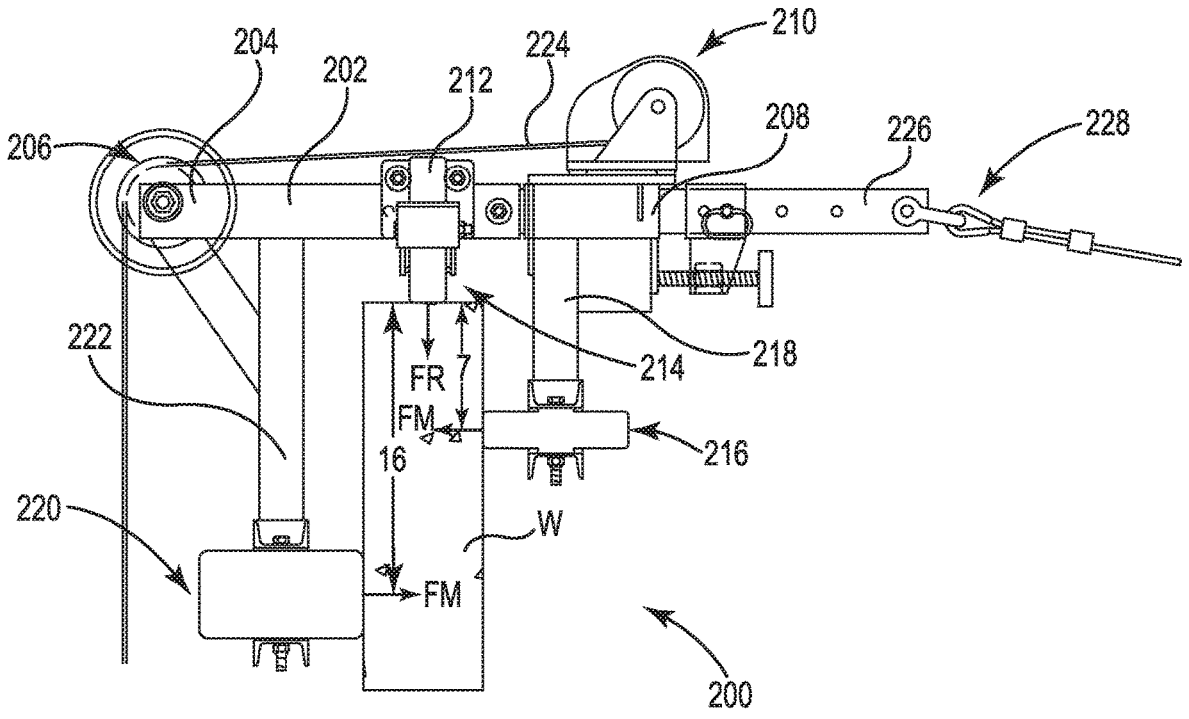
FIG. 19 is a side view of a rolling clamp rigging assembly for use with an automated washing apparatus according to certain embodiments of the invention.

Various types of suitable rigging can be used with the present device, system and method. Referring to FIG. 19, a rolling clamp 200 rigging device is shown. This configuration rolls along a parapet wall W extending above the roof of the building being cleaned. The rolling clamp comprises a generally horizontal body 202 having a first (distal) end 204 with a sheave 206 disposed thereon, and a second (proximal) end 208 having a winch 210 disposed thereon. Note that the dimensions indicated in FIG. 19 are exemplary, and are not intended to be limiting of the scope of the invention.

A top roller bracket 212 is disposed along the body 202 and between the ends 204, 208. A roller wheel 214 is vertically oriented and disposed in the bracket 212 in a position underneath the body so that the clamp assembly 200 can roll along the wall W.

A rear wheel 216 is horizontally disposed against the proximal (inside) surface of the wall W to resist distal or outward horizontal movement of the clamp device 200. The rear wheel 216 extends below the body 202 via a rear wheel bracket 218 so that the wheel rides along the inside surface of the wall W.

A front wheel 220 is horizontally disposed against the distal (outside) surface of the wall W to resist proximal or inward movement of the clamp device 200. The front wheel 220 extends below the body 202 via a front wheel bracket 222 so that the wheel rides along the outside surface of the wall W. Also, the front wheel 220 can be vertically located below the rear wheel 216, as shown in FIG. 19, so that the clamp assembly resists the moment created by weight of the cleaning apparatus suspended by the cable 224.

The wheels 214, 216 and 220 can be formed of any suitable material. In one example embodiment, the top 214 and rear 216 wheels are aluminum, and the front wheel is a soft non-marking pneumatic material. The wheels can also comprise a composite of materials, such as an aluminum hub with rubber outer rim that contacts the wall.

An adjustable tieback member 226 extends proximally towards the building from the second end 208. A tieback cable 228 is fastened to the tieback member 226 so that the clamp 220 cannot fall off of the wall W. This increases safety.

Winch 210 is electrically powered, but can be hand crank-type as well. Alternatively, the winch can be located on the cleaning apparatus and the fixed end attached to the rigging. A remote control for the winch operation is provided in such embodiment.

Figure 20:
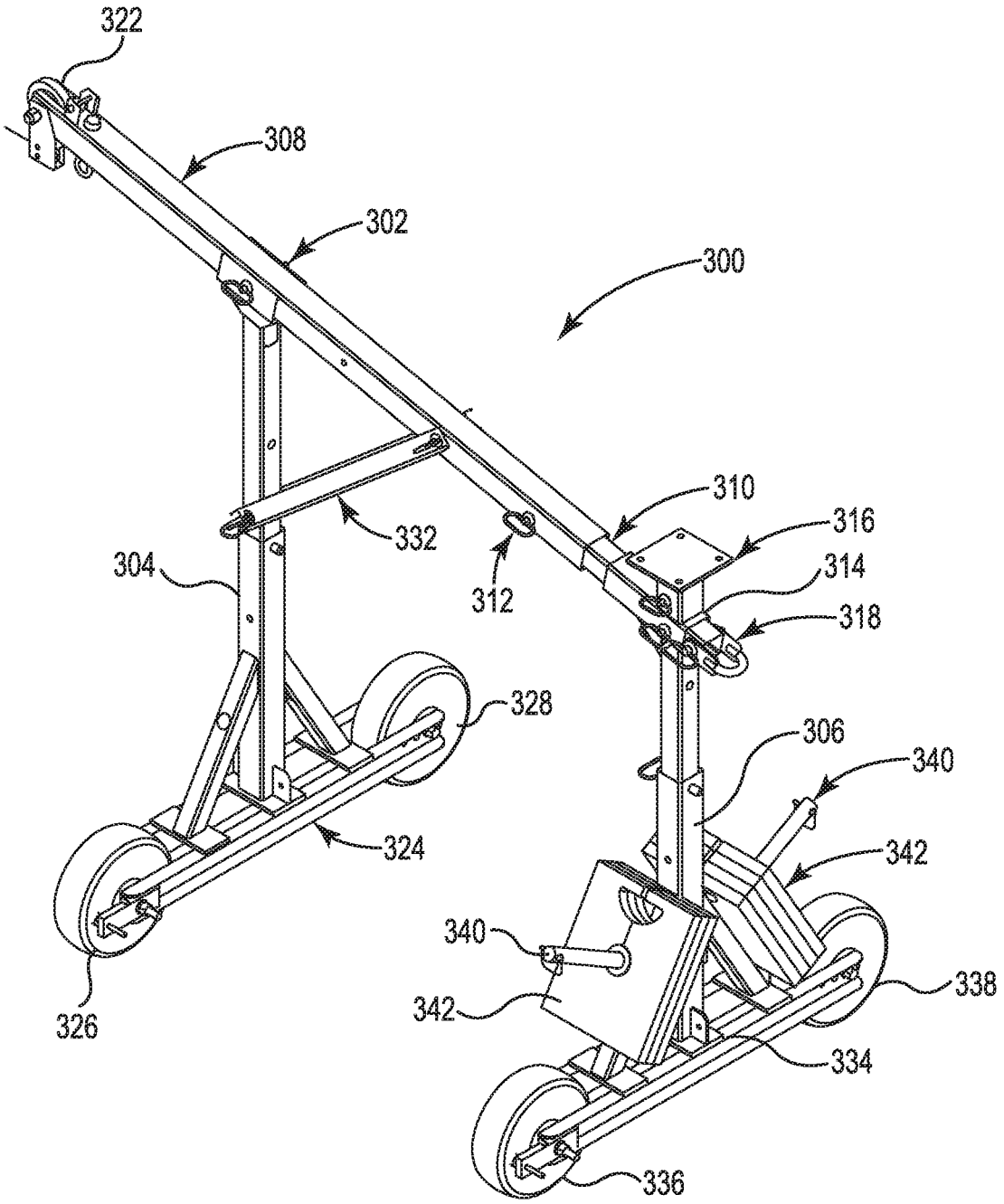
FIG. 20 is a perspective view of a rolling outrigger assembly for use with an automated washing apparatus according to certain embodiments of the invention.
Figure 21:
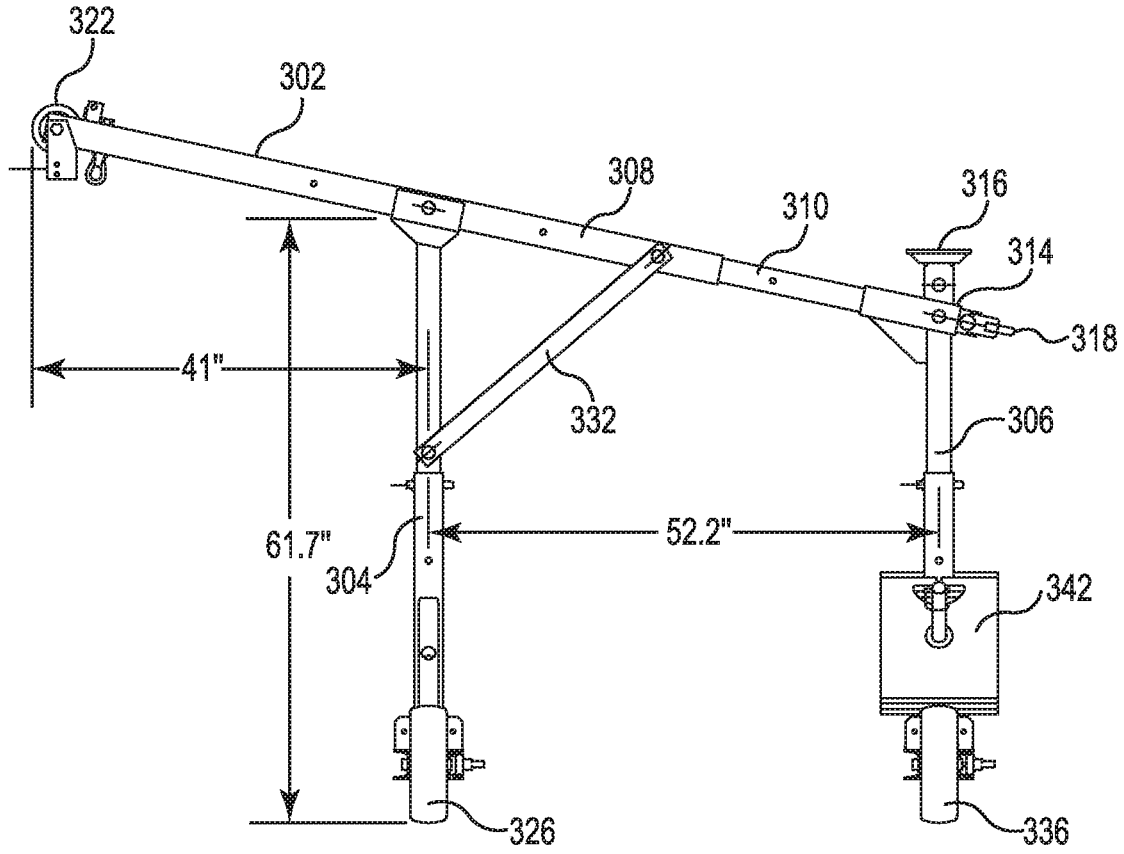
FIG. 21 is a side view of a rolling outrigger assembly for use with an automated washing apparatus according to certain embodiments of the invention.

Referring now to FIGS. 20-21, a rolling outrigger 300 embodiment of rigging is shown. The outrigger 300 comprises a main beam 302, a front wheel assembly 304 and a rear wheel assembly 306. The main beam 302 comprises a hollow outer member 308 and an inner member 310 partially disposed inside of the inner member 308. The inner member 310 slides proximally and distally within the outer member 308 to adjust the length of the main beam 302. A locking pin 312 locks the sliding movement of the inner member with respect to the outer member. The rear or proximal end 314 of the main beam 302 includes a winch mounting bracket 316 and a tether loop 318. The front or distal end 320 of the beam 302 includes a sheave 322 secured thereto.

The front wheel assembly 304 fastens to the beam 302 and extends vertically downward to a wheel assembly 324. The wheel assembly comprises two or more wheels configured to roll the outrigger laterally or sideways (normal to the beam length) along the outer surface of the building. In one embodiment as shown in FIGS. 20-21, a first 326 and second 328 wheels are disposed in the same lateral plane and on opposing lateral sides of the beam 302.

The front wheel assembly 304 is adjustable for height to raise/lower the vertical position of the sheave 322. This height adjustability and the length adjustability of the main beam 302 allows the outrigger to gain clearance over side of the building or other object. In addition, the location where the front wheel assembly 304 is attached to the main beam 304 is adjustable.

A diagonal brace 332 spanning at an angle between the front wheel assembly 304 and the main beam can also be added to provide further stability and support to the outrigger 300. Additional braces can be provided, including braces connecting between the rear wheel assembly 306 and the main beam 302, and between the two wheel assemblies.

The rear wheel assembly 306 fastens to the beam 302 adjacent the proximal end and extends vertically downward to a wheel assembly 334. The rear wheel assembly comprises two or more wheels configured to roll the outrigger laterally or sideways (normal to the beam length) parallel to the outer surface of the building that is being cleaned. In one embodiment as shown in FIGS. 20-21, a first 336 and second 338 wheels are disposed in the same lateral plane and on opposing lateral sides of the beam 302.

The rear wheel assembly 306 further includes one or more posts 340 on which weight plates 342 can be disposed. The weight plates counter the moment arm created by the cleaning apparatus suspended by the cable off the forward end of the beam 302. The user can adjust the amount of weight necessary to reliably maintain the rear wheel assembly in contact with the roof of the building (or other desired contact surface).

The wheels for the wheel assemblies can be any suitable design, including the same as described above for the rolling clamp rigging and airless foam filled swivel wheels. Note that the dimensions indicated in FIG. 21 are exemplary, and are not intended to be limiting of the scope of the invention.

Quick pins can be used to allow for quick assembly/disassembly/adjustment of the various rigging components.

The winch used with outrigger 300 is preferably an electrically powered winch with a suitable weigh rating given he weigh of the cleaning mechanism used.

Figure 22:
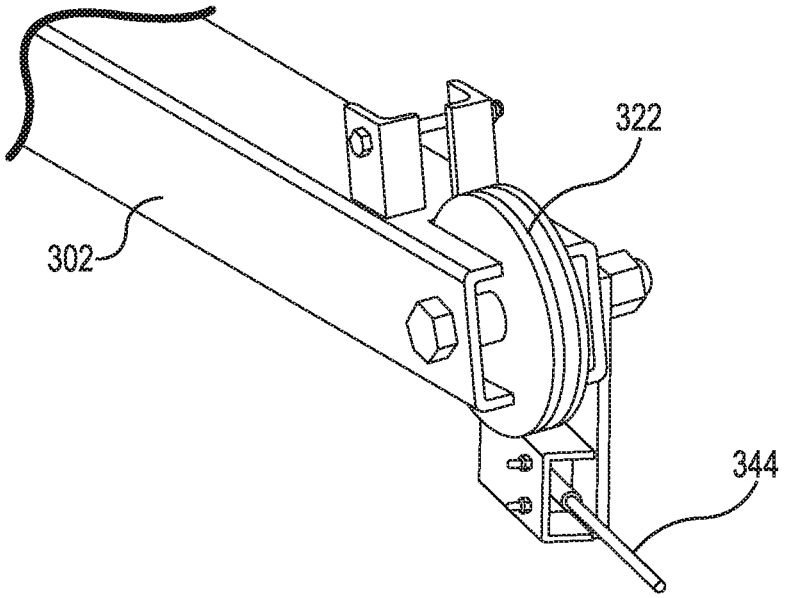
FIG. 22 is a perspective view of a sheave end portion of a rigging assembly for use with an automated washing apparatus according to certain embodiments of the invention.

Referring to the detail view of FIG. 22, a limit switch 344 is shown protruding from the forward (distal) end of the beam 302. The limit switch 344 is also preferably located below the sheave 322. In use, limit switch 344 is contacted by a portion of the cleaning apparatus as it reaches the end of its travel upwards. The contact triggers the switch, which then causes the winch to stop winching. Thus, the winch will not bind and potentially snap the cable. Note that the limit switch is also shown on the outrigger 300 of FIGS. 20-21. The limit switch can also be used the rolling clamp rigging 200 shown in FIG. 19, and with any winching apparatus employed by the operator.

Figure 23:
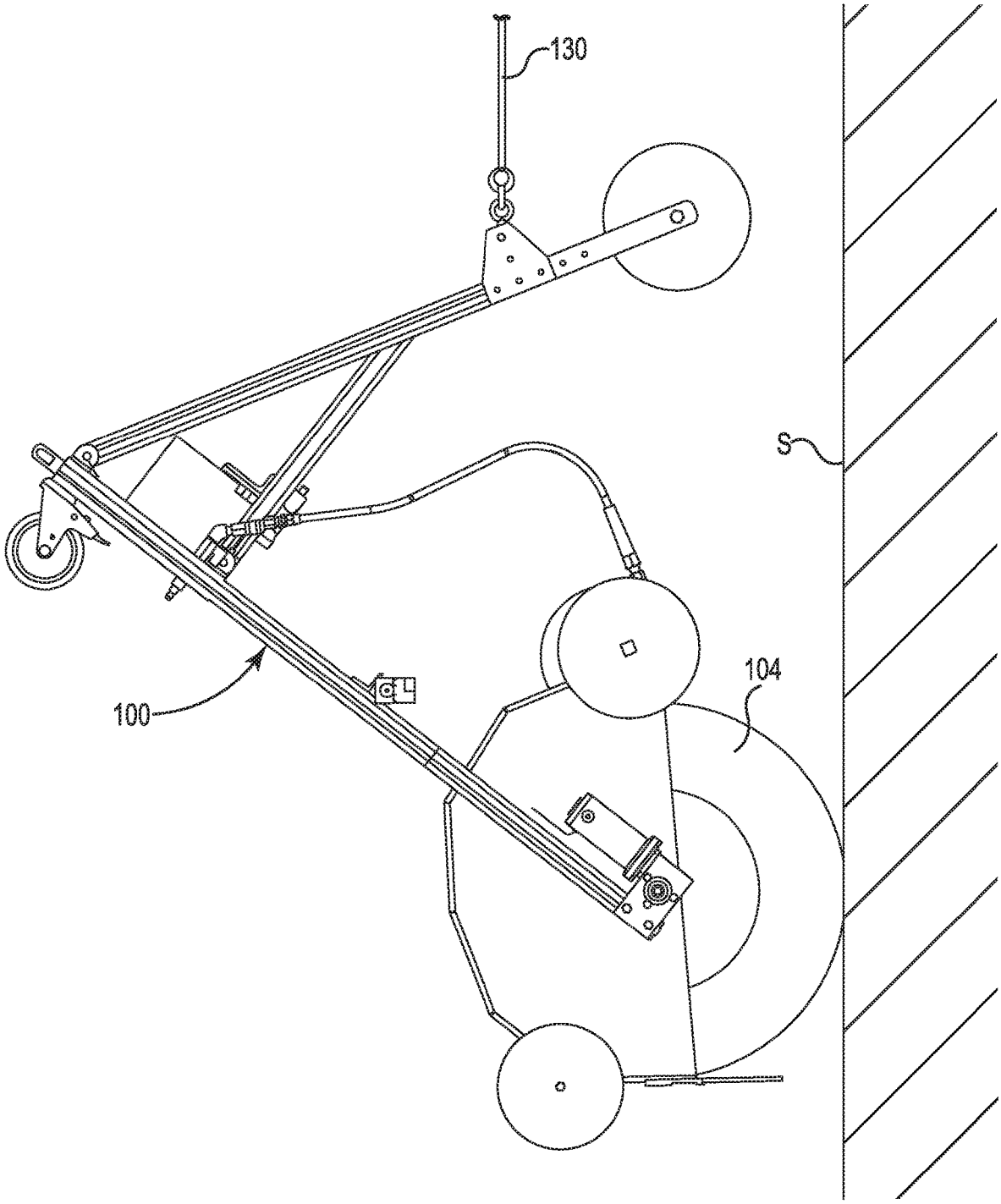
FIG. 23 is a side view of an automated washing apparatus according to certain embodiments of the invention shown suspended by a cable and in a cleaning position against the vertical surface of a building.

Referring to FIG. 23, the cleaning apparatus 100 is shown in use. The main brush 104 is contacting the vertical surface S of the building. It should be understood that the vertical surface of the building need not be perfectly vertical, and may comprise stone, steel, glass and other materials. The cleaning apparatus 100 is suspended by a cable 130.

In one exemplary use scenario, the operator pulls up to the building with a transport vehicle and unloads the cleaning machine 100 as described herein. Then the machine 100 is wheeled to the starting point to be washed. It is hooked up to the hose connected to the water tap or spigot on the building. The water is connected to the inlet of a DI/RO water filtration filter. Then the supply hose (preferably on a reel) connects the outlet side of the filter to the machine's water inlet fitting. The supply hose is unwound from the hose reel and connected to the machine and shackles the strain relief to the eyebolt.

The operator also sets up the rigging on the roof above the area to be washed. The rigging is assembled, including putting on proper weights to the back of the rigging (if outrigger embodiment used). The winch motor is attached to the rigging and plugged in to an electrical outlet or other suitable power supply. Next, the operator ties a rope to an eyebolt on the back of the rigging as a tieback. The other end of the rope is secured to a structurally sound object on the roof in a straight line.

Then the operator takes the remote control unit from the winch and unwinds the wire cable 130 to the ground. A second operator hooks up the cable 130 to the mast of the machine.

Via radio or other communication means, the ground operator calls the rigging operator and has the rigging operator lift the machine up a few feet off the ground. Then the water line is run to make sure all nozzles are spraying DI/RO water. Then the rigging operator makes sure the emergency stop button is pulled out (not engaged). The rigging operator next connects the quick connection to the battery, turns on the brush and lets it spin for about 15 seconds.

If the brush operates satisfactorily, then it is shut off while extending the bumper wheels. The quick pins are also inserted. The machine is now ready to start cleaning.

To clean, the machine and the water supply are turned on. The roof operator then pushes the up button on the winch remote. The winch starts pulling the machine up the building until the main brush reaches the top window. Then the roof operator next reverses the winch and brings the machine down to a few feet off the ground. The roof operator can mark the cable with colored electrical tape to know when the machine is a few feet from the ground. Then the roof operator pushes the rigging sideways approximately three feet to the next area to be cleaned. The wall can be marked with a permanent marker or chalk to indicate where the next area to be clean is located. Then the cleaning process is repeated until all of a given surface is cleaned.

When the machine gets to an inside corner, the ground operator can install the corner brush 106 to the brush motor via a quick pin securement. The opposing brush end can be offset with a small weight connected with a quick pin to the brush motor. This will keep the machine balanced. The roof operator then brings the machine up the building and is now cleaning the inside corner of the building. When the corner is done, the side brush and the weight both need to be taken off if continued non-corner washing is performed.

The cleaning process can be repeated one or two or more times depending on how dirty the building is.

Figure 24:
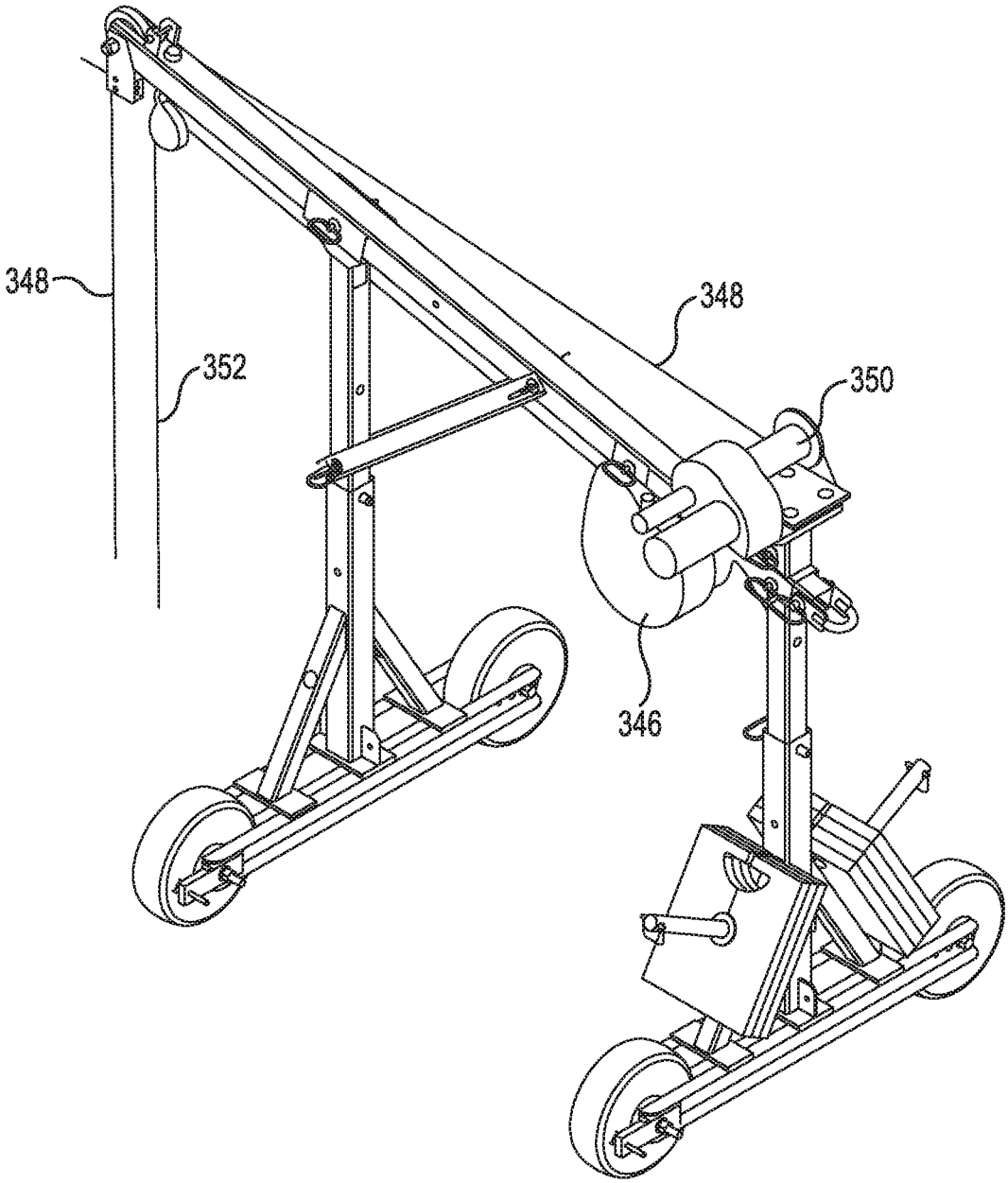
FIG. 24 is a side view of another rolling outrigger assembly for use with an automated washing apparatus according to certain embodiments of the invention.

Referring to FIG. 24, an additional aspect of the invention is shown wherein the rigging 300 is provided with an SRL (self retracting lifeline) 346. Thus, the cleaning apparatus Is attached to the main cable 348 wound by the winch 350 and to the lifeline 352 retractably spooled by the SRL mechanism 346. In operation, if one of the cables/lines should break, the other would stop the cleaning apparatus from falling. Also, if the main winch is electrically powered, and if the power goes out, the SRL mechanism 346 includes a hand crank so that the operator can safely lower the cleaning apparatus to the ground.

A handheld remote control can be used to operate the up/down travel of the cable by the rigging or motor can be put on the wall roller to move horizontally by remote and stop at each place to be cleaned. The remote in additional embodiments can also wirelessly communicate with the washing device to adjust brush spin speed and start/stop the main brush. Use of an electronically adjustable valve in the water line can also enable the operator to adjust cleaning water flow (including on/off/reverse) using the remote. One suitable type is Fimco 12-volt On/Off remote control although other suitable remote controls may be used without departing from the scope of the invention.

In another aspect, the remote described above can be provided with an on/off switch to control the power function for the cleaning machine. Thus power can be quickly stopped, if necessary.

In a further aspect, the water ionization and filtering apparatus can be mounted onboard the cleaning machine. This allows the machine to be simply connected to a water faucet and a separate ionizing and filter apparatus need not be provided.

In yet another aspect, the lift motor and cable winch can be mounted to the machine frame. The winch can be powered by the main battery or a second battery separate from the one used to power the brush(es). This arrangement allows the machine to be operated independent of any on-site power source because the rigging does not need its own power source. The device would only require a fixed point at the top of the building surface to be cleaned to secure the cable to. A lightweight and easily transportable base can thus be used.

Figure 25:
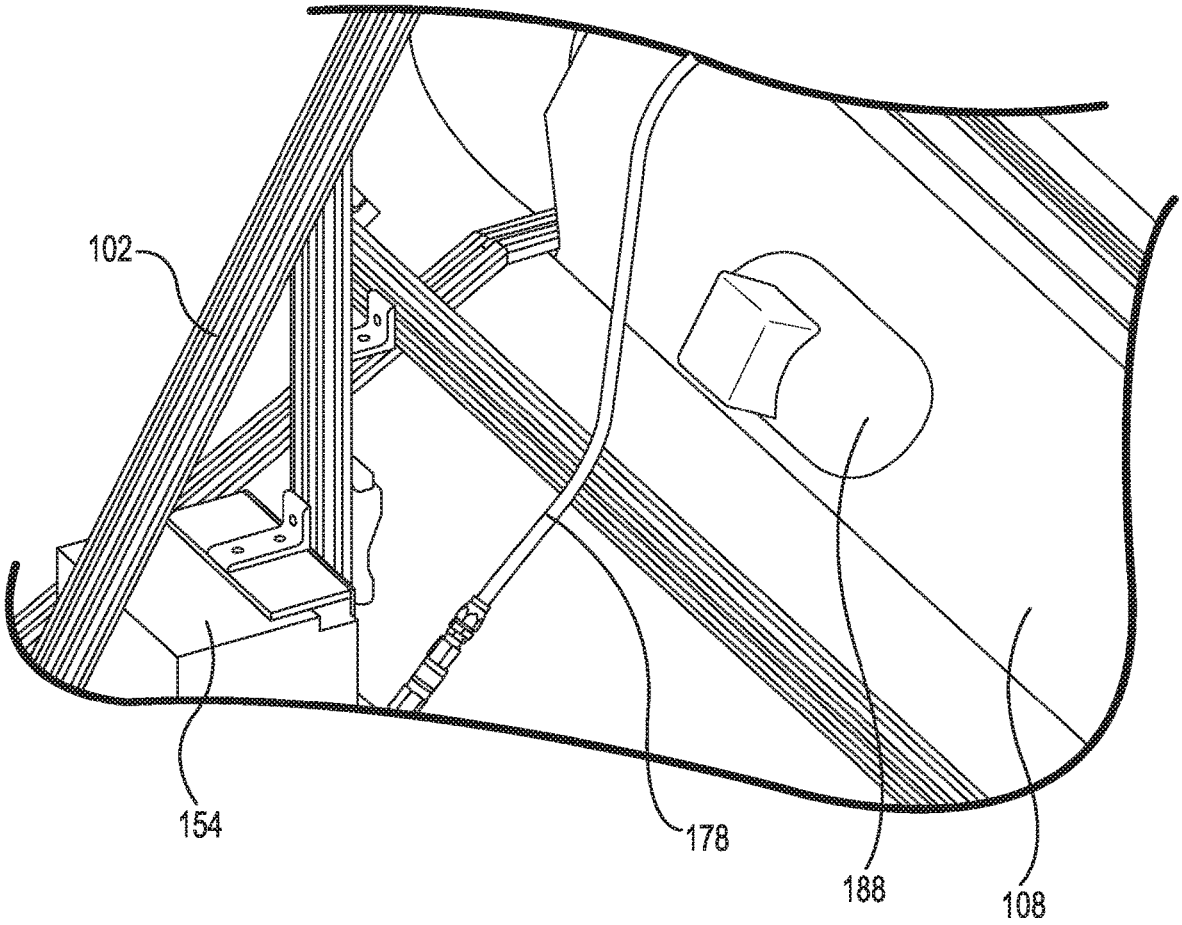
FIG. 25 is a perspective view of an automated washing apparatus with optional gyro stabilizer assembly according to certain embodiments of the invention.

In an additional aspect of the invention, one or more stabilizer gyroscope devices 188 can be disposed on the rear of the shroud 108 facing the battery 154 as shown in FIG. 25. Alternatively the gyroscope can be mounted to the frame, mast, telescoping wheels, etc. to provide for an additional or alternative means to reduce any desire of the cleaning machine to bounce or move away from contact with the window surface when in operation. More than one stabilizer gyro can also be used. Suitable stabilizer gyros such as the KS-4, KS-10 or KS-12 units are available from Kenyon Laboratories LLC, but other models and brands of gyro stabilizer can be used without departing from the scope of the invention. The stabilizer gyro functions to resist any sudden motion of the machine away from the building. It effectively operates as a damper on the frequency and amplitude of forces that would cause the cleaning machine to move away from the cleaning surface. The rotational axis can be adjusted to maximize this stabilizing effect.

Gyro stabilizers can additionally or alternatively be positioned such that the rotational axis is parallel to the axis of the cleaning brush rotation. Such positioning will dampen and resist any twisting motion about a vertical axis by the machine. Such gyro stabilizers can even be incorporated into the wheels with a product called the GYROWHEEL from Gyrobike.

The stabilizer gyro(s) can be powered by the main battery or secondary battery. The on/off and spin speed variables can be controlled by a remote control or by switches on the gyro housing itself, or on a remote location on the cleaning apparatus.

The rotating cleaning brush can be replaced with a rotating dusting brush and used to dust buildings without water. In some climates, the source of unsightly contaminants on buildings is mostly dust and sand particles. Thus a waterless cleaning process is desirable. This is particularly well suited for climates where water is scarce.

Figure 26:
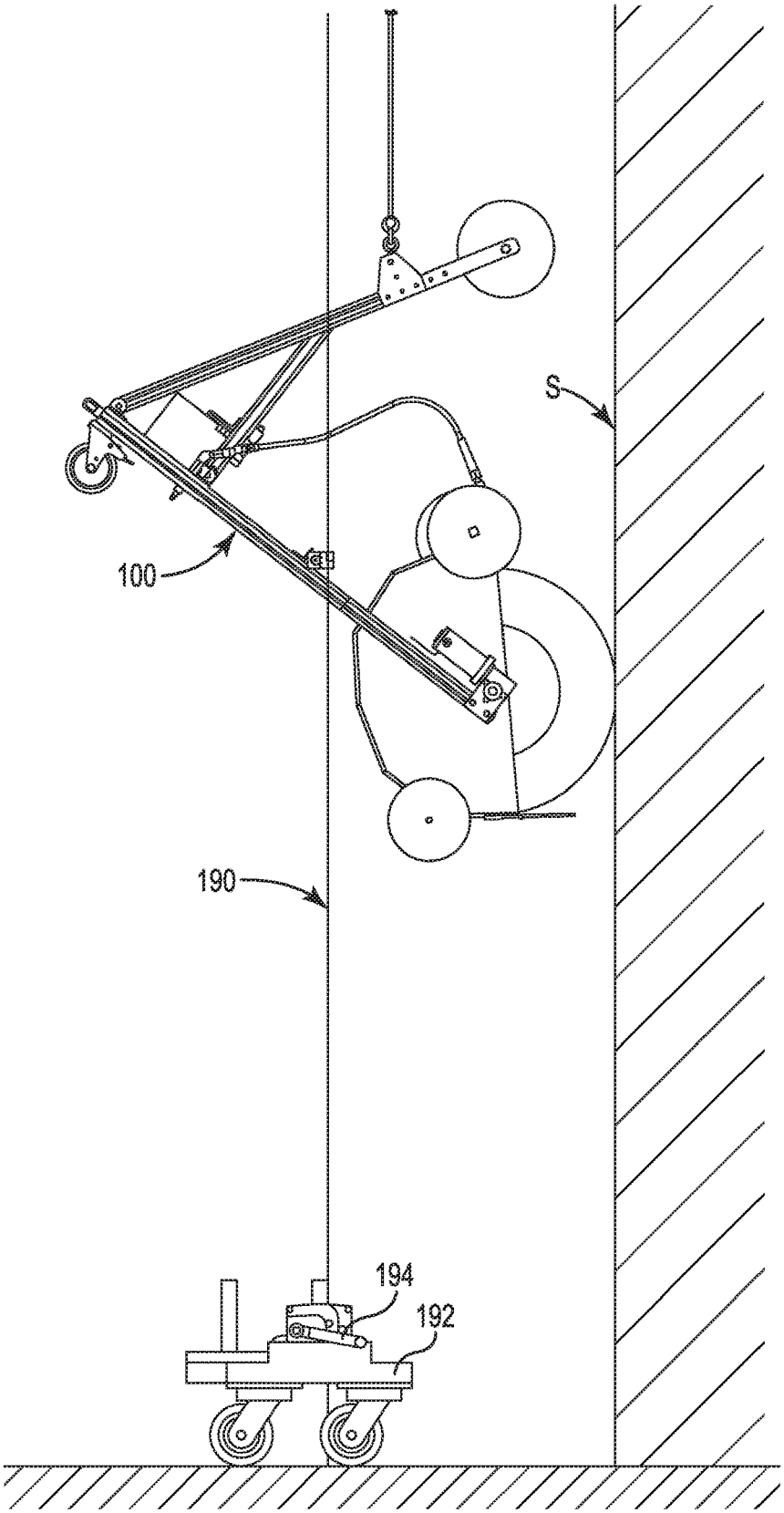
FIG. 26 is a side view of an automated washing apparatus according to certain embodiments of the invention shown suspended by a cable, including guidelines, and in a cleaning position against the vertical surface of a building.
Figure 27:
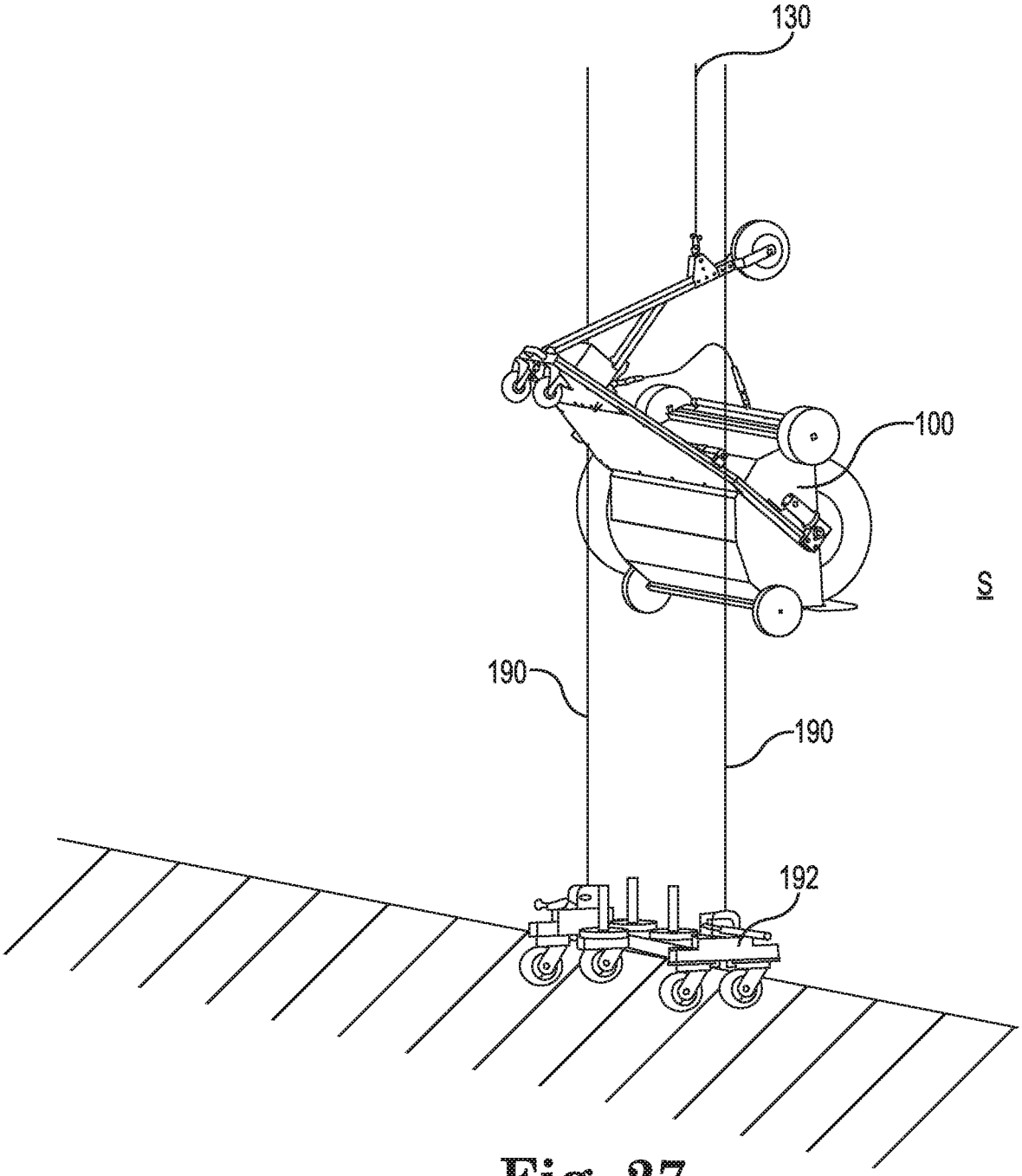
FIG. 27 is a perspective view of an automated washing apparatus according to certain embodiments of the invention shown suspended by a cable, including guidelines, and in a cleaning position against the vertical surface of a building.

Referring now to FIGS. 26-27, the cleaning apparatus is shown with attached guidelines 190. The guide lines extend from the rigging (wherein a lateral member or arms are attached to the main beam) down to a weight cart 192 disposed on the ground. The cart 192 includes a hand winch 194 to tighten the lines 190 as needed. Weights can be added to the cart for added stability. The guidelines function to help hold the machine 100 against the building, and to resist twisting and sideways movements. The arms on the main beam of the rigging can also be provided with respective winches to tighten the guidelines 190.

The following are certain features of some embodiments of the invention. Some or all of these features may be present in a given embodiment. The following is not an exhaustive list and not all features need be present in a given embodiment to fall within the scope of the invention. The main brush can be 40 inches long and configures as a quick change brush. The batteries can be 12 Volt-type with a quick charger for constant operation. Each battery can last 6-8 hours and have a 2-3 hour recharge time. The cleaning apparatus/machine is sized to fit into a pickup truck bed. The machine can use less than a ½ gallon of DI/RO water per a minute in cleaning operation. The invention herein can clean a building more than 25 times faster than a manual window cleaning process. The invention can save money on insurance because there are no people dangling from ropes. No chemicals are needed to for a cleaning solution. The cleaning speed can be 10 to 50 linear feet per minute or 150 square feet per minute. Speed is selectably variable. Only two people are needed for cleaning a building. Quick on and off connections can be used. Set-up is simple and the machine can be ready to clean in les than 30 minutes. Parts are easily replaced in minutes if necessary. Weight is light at approximately 100 lbs. Machine color can be varied and an area on shroud can be provided with advertising graphics. The machine is easily moved with wheels and fits through a single standard garage door. The machine does not damage building. It also can clean the whole building, including both windows and frames.

The machine 100 and corresponding rigging can also be transported via a trailer that is sufficiently small to be pulled behind most non-commercial pickup trucks or cars. The machine can be battery powered, so no complicated and heavy power cables are needed. The counterweight created by angle of the mast intersecting the planar base portion, with battery opposite of the main brush keeps the main brush in smooth contact with window surfaces. The rigging winch can conveniently operate with common 110 Volts (US) or 220 v (international) electrical input. A lightweight 3/16 inch diameter cable can be used because the cleaning apparatus is so light. In one embodiment, the winch weighs only 42 lbs. Operation is quiet because there are no noisy fans. An onboard water tank (e.g. 5 Gal.) can be provided to supply cleaning fluid. The cleaning apparatus can be folded for storage. Additional features and advantages will be apparent to those of skill in the art upon reviewing this specification.

The device and system of the invention can also be used to clean both the windows and siding of a residential house or small apartment complex.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. An automated washing system for vertical surfaces of buildings, the system comprising:

a frame assembly, comprising a front end, rear end and opposing first and second sides;

a main brush rotatably disposed between the opposing sides of the frame assembly and adjacent the rear end thereof, the main brush defining a circumferential outer surface and opposing circular ends;

a side brush disposed on the first side of the frame assembly;

an electric drive motor operably connected to the main brush and the side brush; and a first bumper wheel and a second bumper wheel, each disposed longitudinally external to a respective one of the opposing circular ends of the main brush where the first and second bumper wheels can contact the vertical surfaces of building during a cleaning operation, wherein each of the first and second bumper wheels is mounted on a telescoping member, which can respectively each telescope longitudinal outward from each respective circular end of the main brush body.

2. The system of claim 1, further comprising a rolling clamp rigging assembly, comprising:

a generally horizontal body having a first end and a second end;

a sheave disposed on the first end;

a winch disposed on the second end;

a vertically oriented roller wheel disposed below the body and located horizontally between the first and second ends;

a horizontally oriented rear wheel extending vertically below the body and located horizontally between the second end and the roller wheel; and a horizontally oriented front wheel extending vertically below the body and located horizontally between the first end and the roller wheel.

3. The system of claim 1, further comprising a rolling outrigger assembly, comprising:

a main beam having a first end, a second end and a longitudinal length defined between the first and second ends;

a sheave disposed adjacent the first end;

a winch mounting bracket disposed adjacent the second end;

a front wheel assembly being height adjustable and attachable to the beam and extending vertically downward from the beam, the front wheel assembly including a plurality of wheels configured to roll in a direction normal to the length of the beam; and a rear wheel assembly attachable to the beam and extending vertically downward from the beam, the rear wheel assembly including a plurality of wheels configured to roll in a direction normal to the length of the beam.

4. The system of claim 3, further comprising a limit switch disposed on the first end of the beam and located vertically below the sheave.

5. The system of claim 3, further comprising a self retracting lifeline disposed on the beam.

6. The system of claim 1, further comprising a counterweight disposed on the second side of the frame assembly opposite the side brush.

7. The system of claim 1, further comprising a gyroscope stabilizer device disposed on the automated washing system.

8. The system of claim 1, further comprising:

a plurality of guidelines secured to the automated washing system; and a weight cart attached to the guidelines.

9. An automated washing system for vertical surfaces of buildings, the system comprising:

a frame assembly;

a main brush rotatably mounted to the frame assembly, the main brush defining a circumferential outer surface and opposing circular ends;

a shroud extending the length of the main brush and enclosing a portion of the of the circumferential surface of the main brush opposite the vertical surface of the building;

an electric drive motor operably connected to the main brush;

a side brush disposed on a first side of the frame assembly; and at least two bumper wheels, with at least one bumper wheel located longitudinally external to each of the opposing circular ends of the main brush where the at least two bumper wheels can contact the vertical surfaces of building during a cleaning operation, wherein the at least two bumper wheels are each disposed on telescoping members that are extendable laterally outwardly from the opposing circular ends of the main brush.

10. The system of claim 9, further comprising a second electric drive motor disposed adjacent one of the opposing circular ends of the main brush opposite the first electric drive motor.

11. The system of claim 9, further comprising a counterweight disposed on a second side of the frame assembly opposite the side brush.

12. The system of claim 9, further comprising a gyroscope stabilizer coupled to the frame assembly.

13. The system of claim 9, further comprising a caster wheel disposed on the frame.

14. The system of claim 9, further comprising a spray bar disposed on the shroud and configured to spray a cleaning fluid on the circumferential outer surface of the main brush.

15. The system of claim 9, further comprising a top bumper wheel disposed on an upward-most extending portion of the frame.

16. The system of claim 9, further comprising a spacer disk disposed adjacent each circular end of the main brush body.

17. An automated washing system for vertical surfaces of buildings, the system comprising:

a frame;

a main brush rotatably disposed in the frame, the main brush defining a circumferential outer surface and opposing circular ends;

a side brush disposed on a first end of the frame adjacent to one of the opposing circular ends of the main brush; and at least two bumper wheels provided to opposing ends of the frame where the at least two bumper wheels can contact the vertical surfaces of building during a cleaning operation, wherein the at least two bumper wheels are each disposed on telescoping members that are extendable laterally outwardly from the opposing circular ends of the main brush.

18. The system of claim 17, further comprising a counterweight disposed on a second end of the frame opposite the side brush and adjacent to one of the opposing circular ends of the main brush.

* * * * *